US010413014B2

(12) United States Patent
Vindriis

(10) Patent No.: US 10,413,014 B2
(45) Date of Patent: Sep. 17, 2019

(54) BALANCE-IMPROVING LIQUID-FILLED INSOLE FOR USE IN THERAPEUTICS, REHABILITATION, STANDING AND WALKING WORK AND SPORTS

(71) Applicant: MEDICOVI ApS, Hovedgård (DK)

(72) Inventor: Peter Vindriis, Hovedgård (DK)

(73) Assignee: MEDICOVI ApS, Hovedgård (DK)

( * ) Notice: Subject to any disclaimer, the term of this patent is extended or adjusted under 35 U.S.C. 154(b) by 456 days.

(21) Appl. No.: 15/105,629

(22) PCT Filed: Dec. 17, 2014

(86) PCT No.: PCT/DK2014/050435
§ 371 (c)(1),
(2) Date: Jun. 17, 2016

(87) PCT Pub. No.: WO2015/090331
PCT Pub. Date: Jun. 25, 2015

(65) Prior Publication Data

US 2017/0000211 A1 Jan. 5, 2017

(30) Foreign Application Priority Data

Dec. 20, 2013 (DK) ..... 2013 70812

(51) Int. Cl.
*A43B 7/14* (2006.01)
*A43B 17/00* (2006.01)
(Continued)

(52) U.S. Cl.
CPC ..... *A43B 7/147* (2013.01); *A43B 5/00* (2013.01); *A43B 7/141* (2013.01); *A43B 7/142* (2013.01);
(Continued)

(58) Field of Classification Search
CPC ..... A43B 7/147; A43B 13/20; A43B 17/02; A43B 17/026; A43B 17/006; A43B 17/14; A43B 17/18
(Continued)

(56) References Cited

U.S. PATENT DOCUMENTS 3,417,494 A * 12/1968 Claff ..... A43B 1/0045 36/3 B
3,724,106 A * 4/1973 Magidson ..... A43B 17/026 36/44
(Continued)

FOREIGN PATENT DOCUMENTS

AU 2766684 A 12/1984
DE 19522100 A1 11/1996
(Continued)

*Primary Examiner* — Shaun R Hurley
*Assistant Examiner* — Bao-Thieu L Nguyen
(74) *Attorney, Agent, or Firm* — James Creighton Wray; Meera P. Narasimhan

(57) ABSTRACT

An insole made of two membrane foils, between which a liquid is provided. The membrane foils have very little elasticity and high stiffness to respond quickly to load by pushing liquid quickly from an area under the foot to another area of the foot, by which the balance response is made faster for a person who uses such insoles. Especially in the field of multiple sclerosis, post-stroke rehabilitation, golf and race have such insoles have proven to be very advantageous.

23 Claims, 19 Drawing Sheets

(51) Int. Cl.

| | |
|---|---|
| ***A43B 17/04*** | (2006.01) |
| ***A43B 17/08*** | (2006.01) |
| ***A43B 17/18*** | (2006.01) |
| ***A43B 5/00*** | (2006.01) |
| ***A43B 7/18*** | (2006.01) |
| ***A43B 7/32*** | (2006.01) |
| ***A43B 17/02*** | (2006.01) |

(52) U.S. Cl.
CPC ..... *A43B 7/143* (2013.01); *A43B 7/144* (2013.01); *A43B 7/1425* (2013.01); *A43B 7/1445* (2013.01); *A43B 7/1465* (2013.01); *A43B 7/18* (2013.01); *A43B 7/32* (2013.01); *A43B 17/003* (2013.01); *A43B 17/006* (2013.01); *A43B 17/026* (2013.01); *A43B 17/04* (2013.01); *A43B 17/08* (2013.01); *A43B 17/18* (2013.01)

(58) Field of Classification Search
USPC ..... 36/43, 44
See application file for complete search history.

(56) References Cited

U.S. PATENT DOCUMENTS 3,914,881 A * 10/1975 Striegel ..... A43B 7/28 36/153
4,017,931 A * 4/1977 Golden ..... A43B 17/03 12/146 B
4,115,934 A * 9/1978 Hall ..... A43B 17/026 36/29
4,567,677 A * 2/1986 Zona ..... A43B 13/20 36/28
5,167,999 A * 12/1992 Wang ..... A43B 7/1425 36/30 R
5,832,630 A * 11/1998 Potter ..... A43B 13/203 36/29
5,878,510 A * 3/1999 Schoesler ..... A43B 7/147 36/153
6,138,382 A * 10/2000 Schoesler ..... A43B 7/147 36/153
6,178,663 B1 * 1/2001 Schoesler ..... A43B 17/026 36/29
6,258,421 B1 * 7/2001 Potter ..... A43B 13/20 36/28
6,280,815 B1 * 8/2001 Ersfeld ..... A43B 7/142 36/3 B
6,428,865 B1 * 8/2002 Huang ..... A43B 1/0009 36/29
6,510,624 B1 * 1/2003 Lakic ..... A43B 5/0407 36/28
6,665,959 B1 * 12/2003 Vindriis ..... A43B 7/06 36/29
6,865,823 B1 * 3/2005 Vindriis ..... A43B 13/12 36/153
7,013,584 B2 * 3/2006 Vindriis ..... A43B 17/03 36/29
7,243,446 B2 * 7/2007 Vindriis ..... A43B 7/141 36/141
7,410,684 B2 * 8/2008 McCormick ..... A41D 31/0038 428/190
7,854,075 B2 * 12/2010 Kosmas ..... A43B 7/142 36/43
2006/0254088 A1 * 11/2006 McCormick ..... A41D 31/0038 36/44
2008/0028638 A1 * 2/2008 Morita ..... A43B 7/142 36/44
2008/0047164 A1 * 2/2008 Vindriis ..... A43B 7/1425 36/29
2009/0038180 A1 * 2/2009 Jacob ..... A43B 1/0054 36/44
2009/0126226 A1 * 5/2009 Morita ..... A43B 17/026 36/43
2011/0030243 A1 * 2/2011 Tersigni ..... A43B 7/36 36/103
2011/0167673 A1 * 7/2011 Majak ..... A43B 17/026 36/44
2013/0008050 A1 * 1/2013 Marc ..... A43B 17/026 36/44
2013/0227858 A1 * 9/2013 James ..... A43B 13/20 36/88
2013/0340295 A1 * 12/2013 Adami ..... A43B 5/02 36/25 R
2014/0325872 A1 * 11/2014 Huang ..... A43B 17/026 36/43

FOREIGN PATENT DOCUMENTS

| | | | |
|---|---|---|---|
| EP | 0370413 | A2 | 5/1990 |
| EP | 1891869 | A1 | 2/2008 |
| GB | 2498196 | A | 7/2013 |
| WO | 2004010811 | A1 | 2/2004 |
| WO | 2013006393 | A1 | 1/2013 |

* cited by examiner

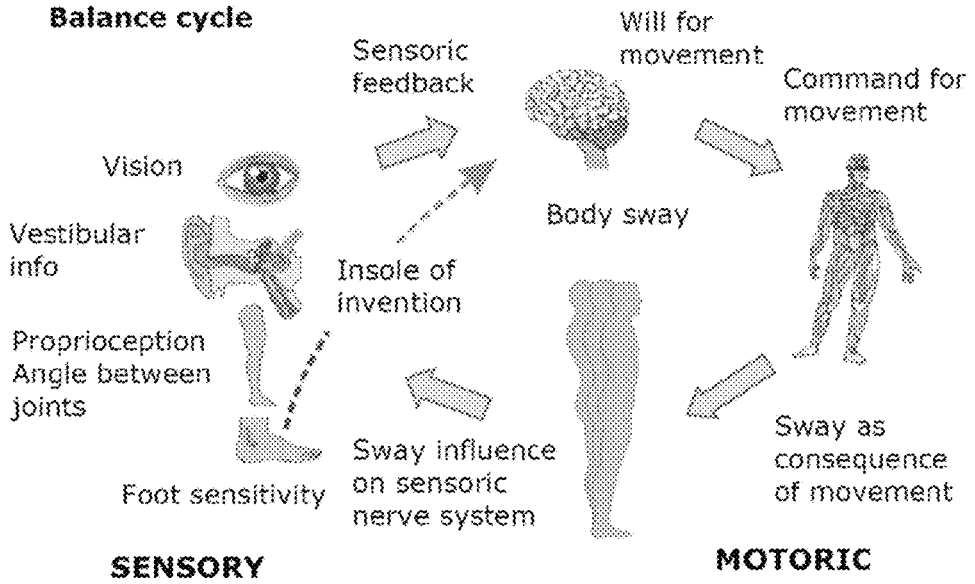
Fig.1.1
Fig 1.2
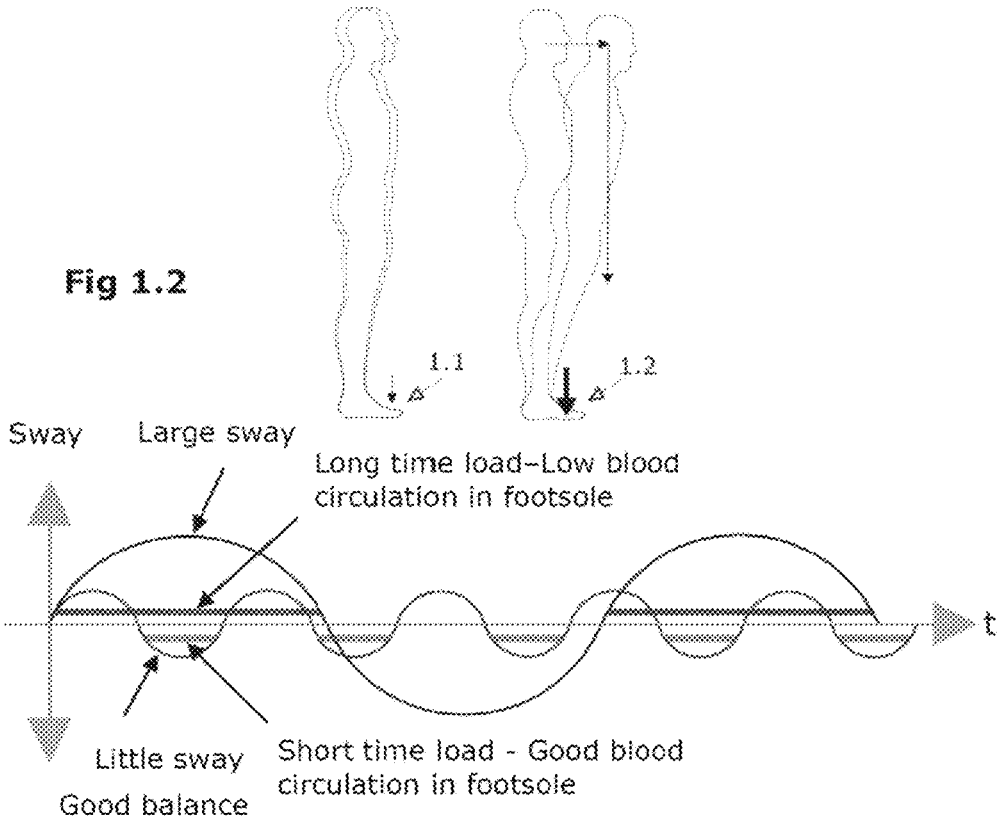

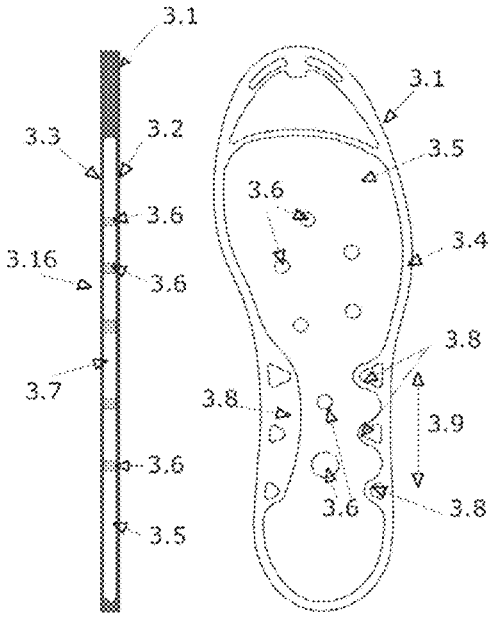
Fig 3.1
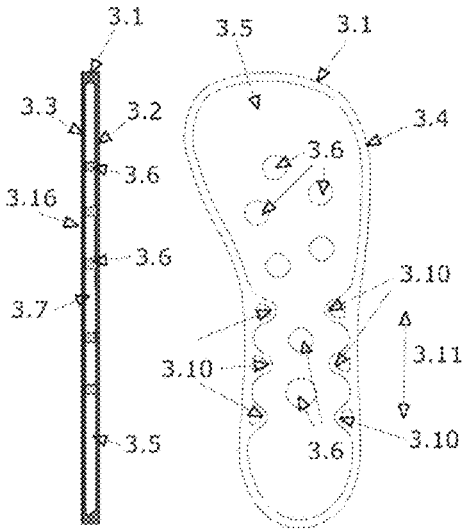
Fig 3.2
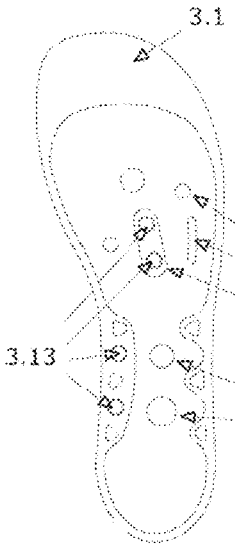
Fig 3.3
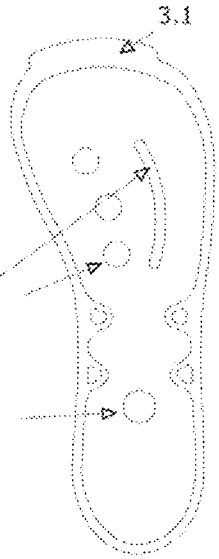
Fig 3.4
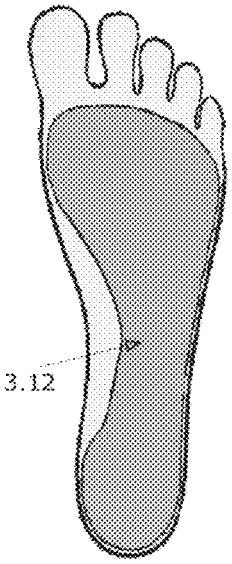
Fig 3.5

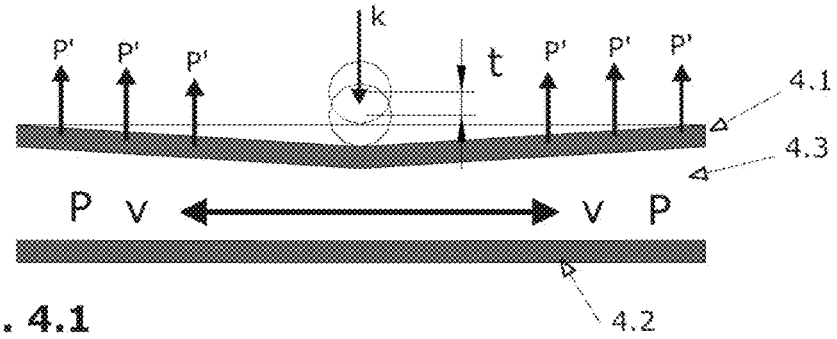
Fig. 4.1
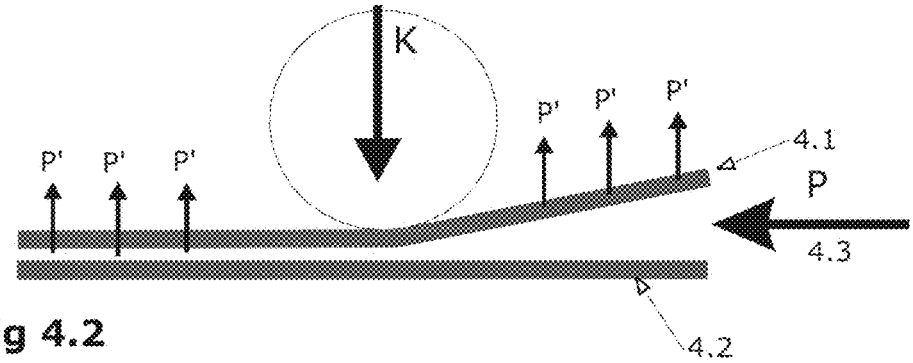
Fig 4.2
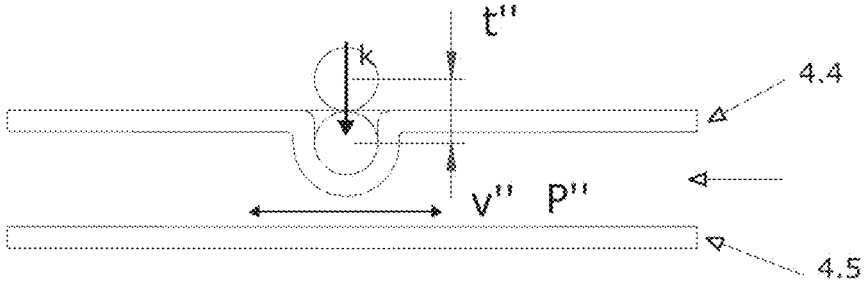
Fig 4.3
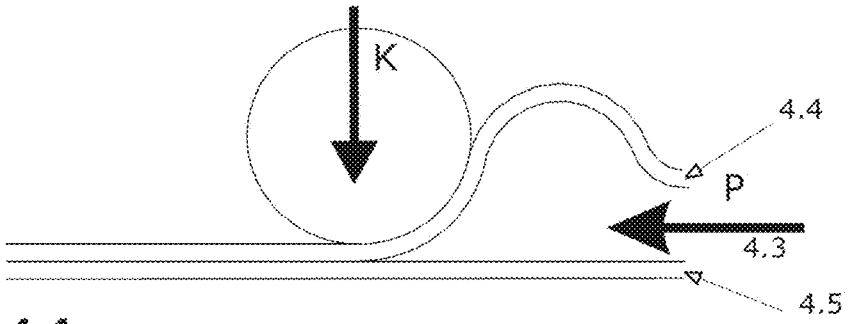
Fig 4.4

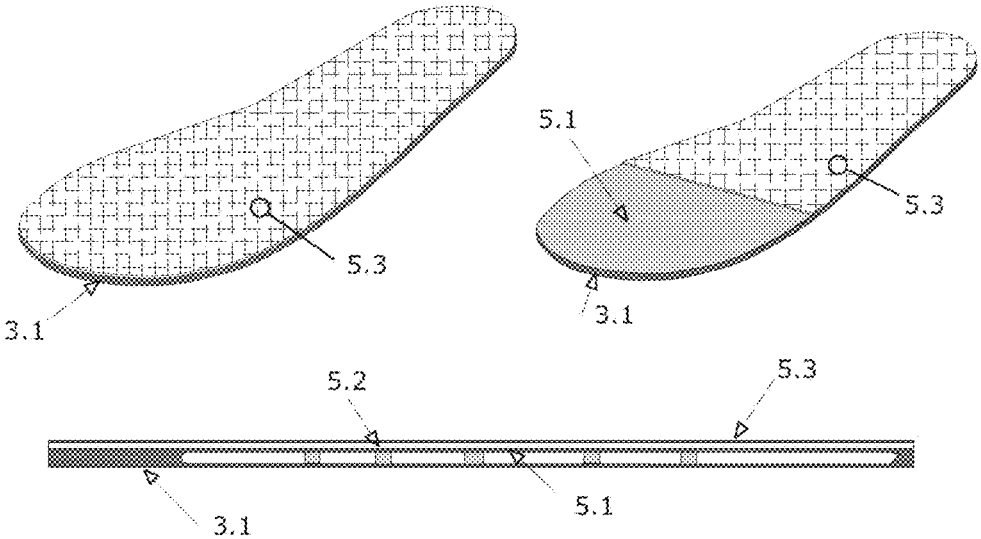
Fig. 5.1
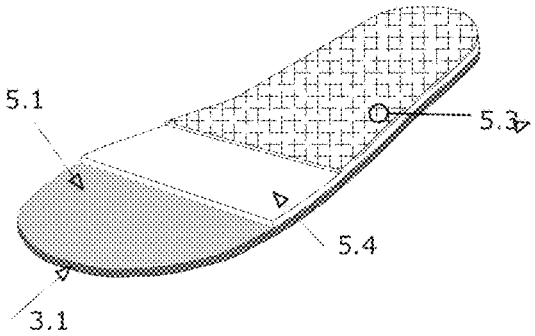
Fig. 5.2
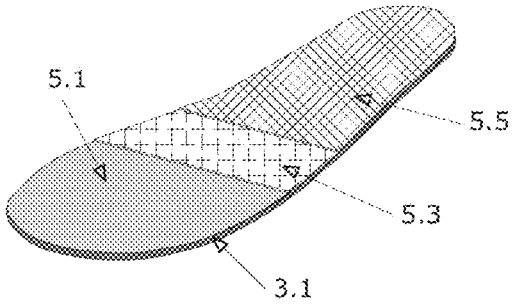
Fig 5.3

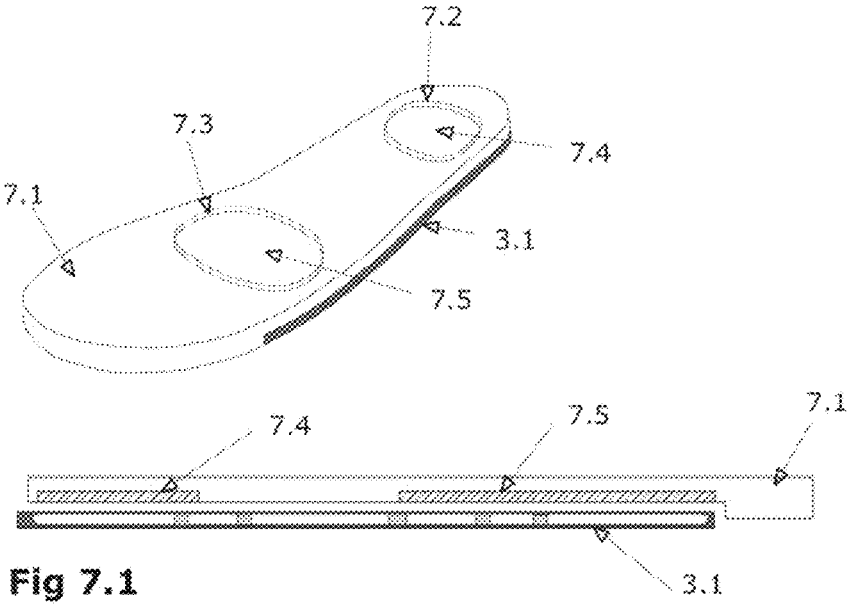
Fig 7.1
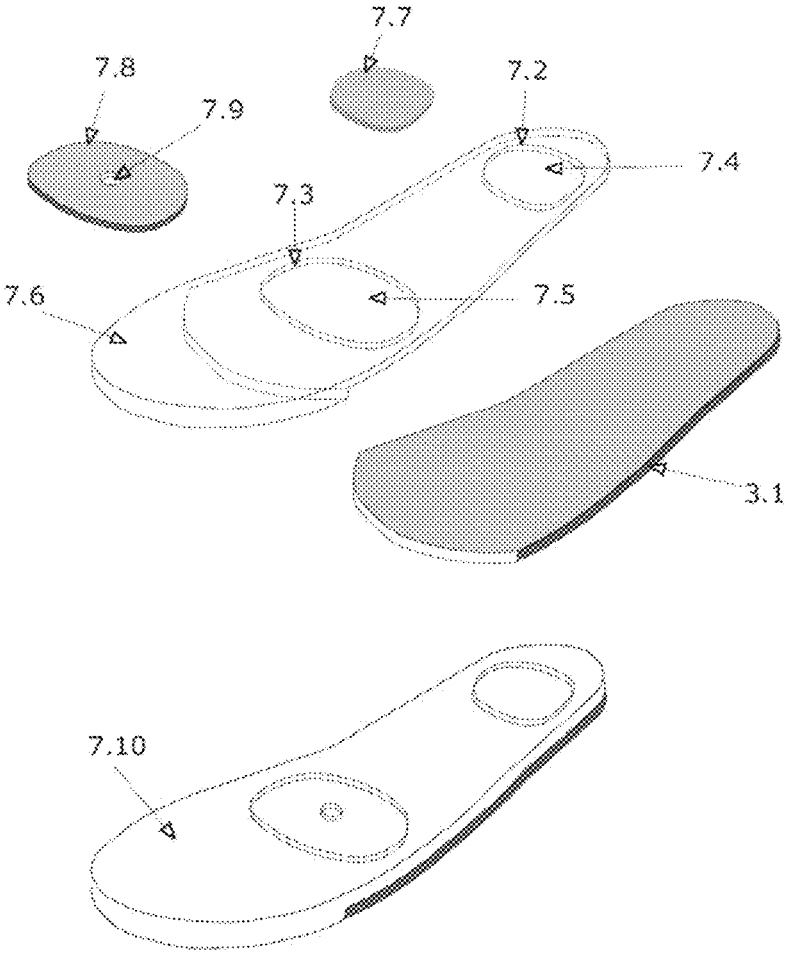
Fig 7.2

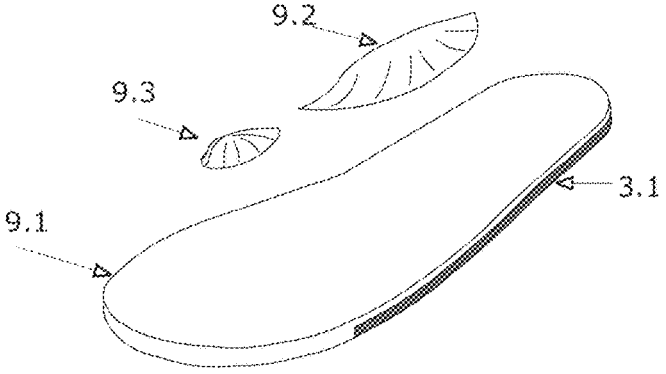
Fig 9.1
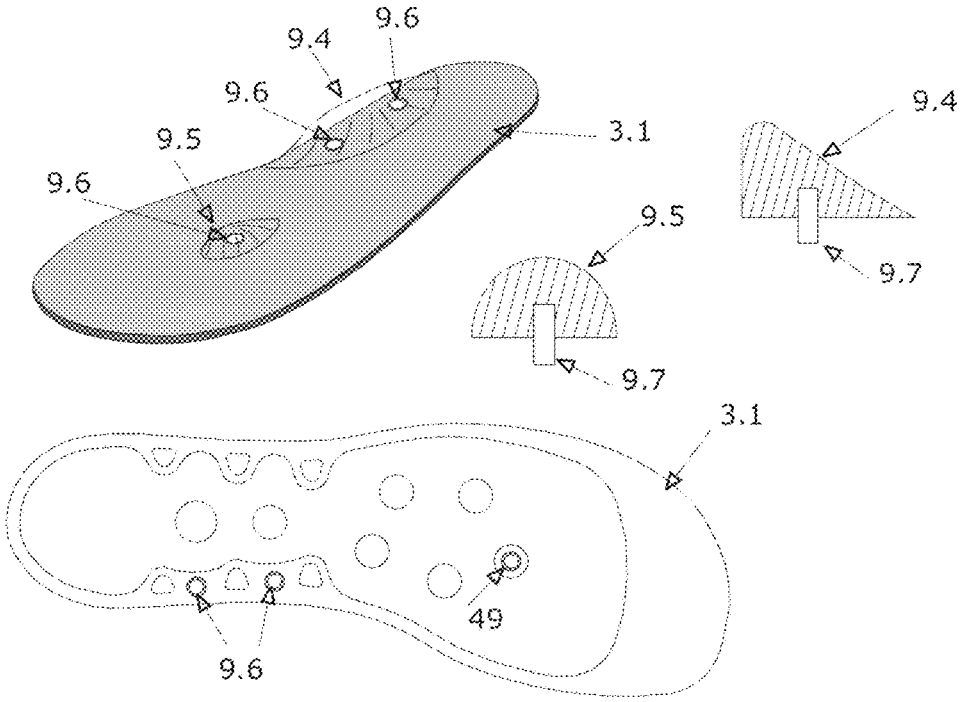
Fig 9.2
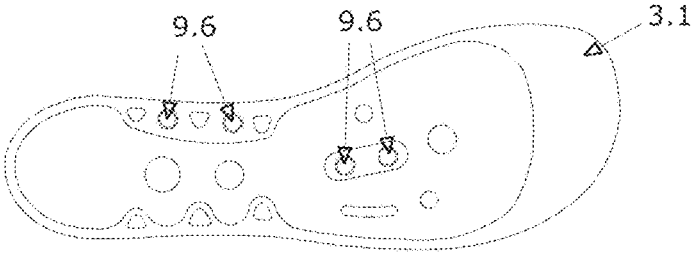

Fig 10
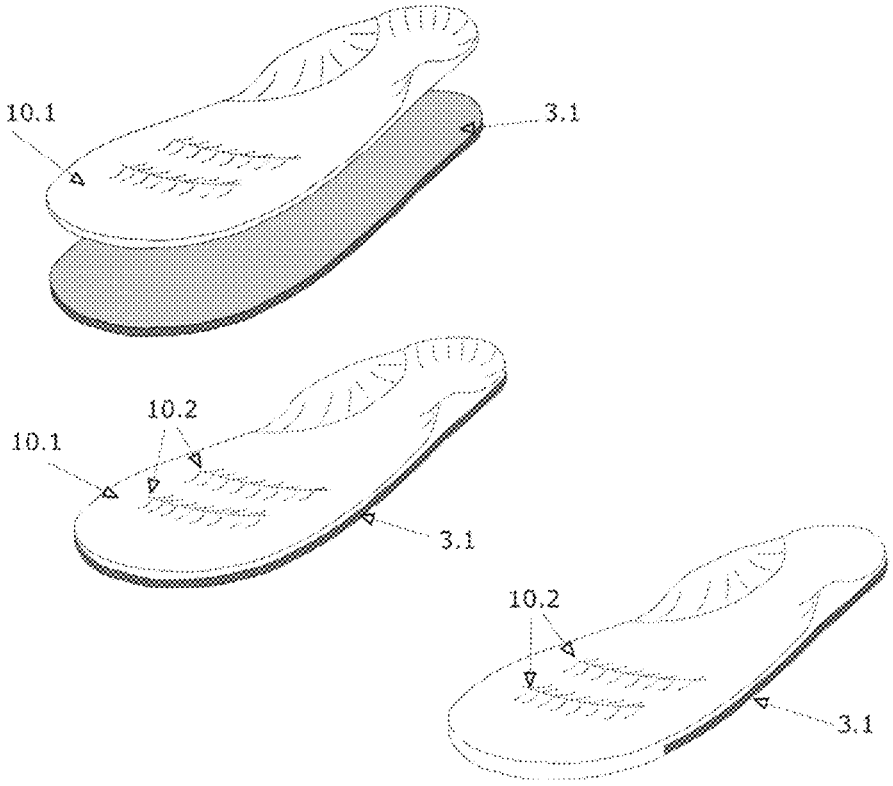
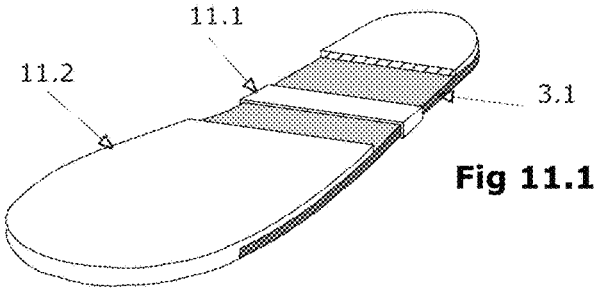
Fig 11.1
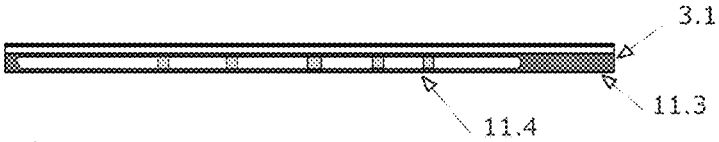
Fig 11.2

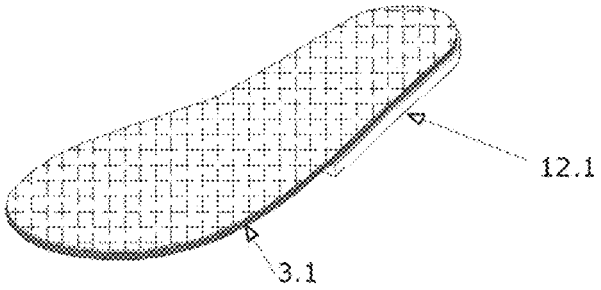
Fig 12.1
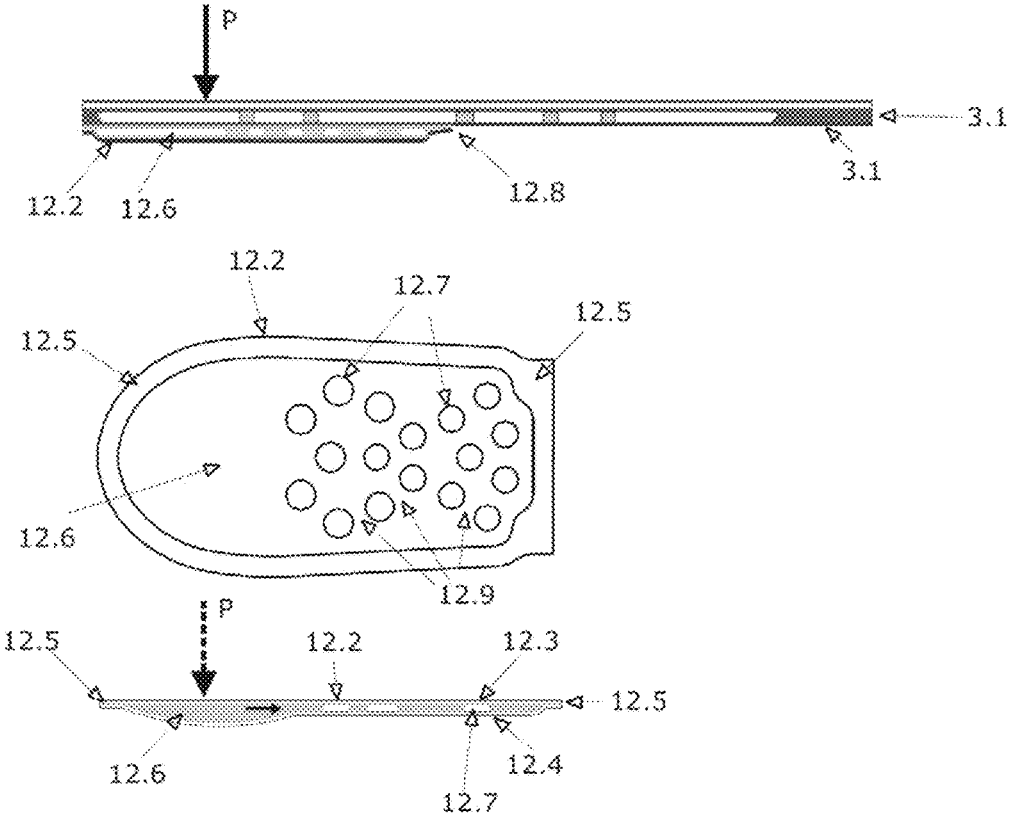
Fig 12.2

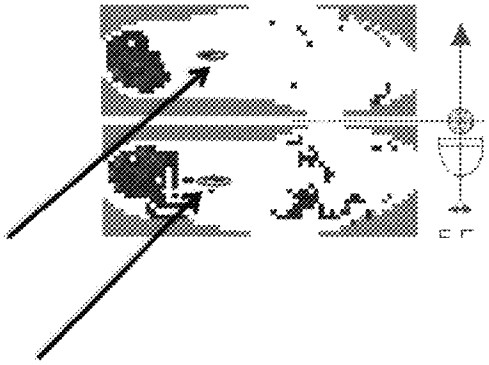
FIG 13.1
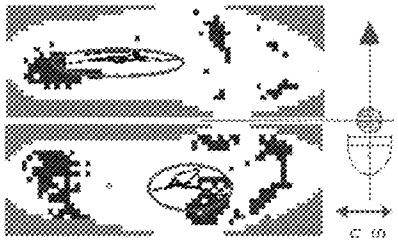
FIG. 13.2
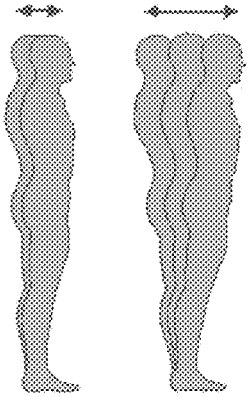
FIG. 13.3

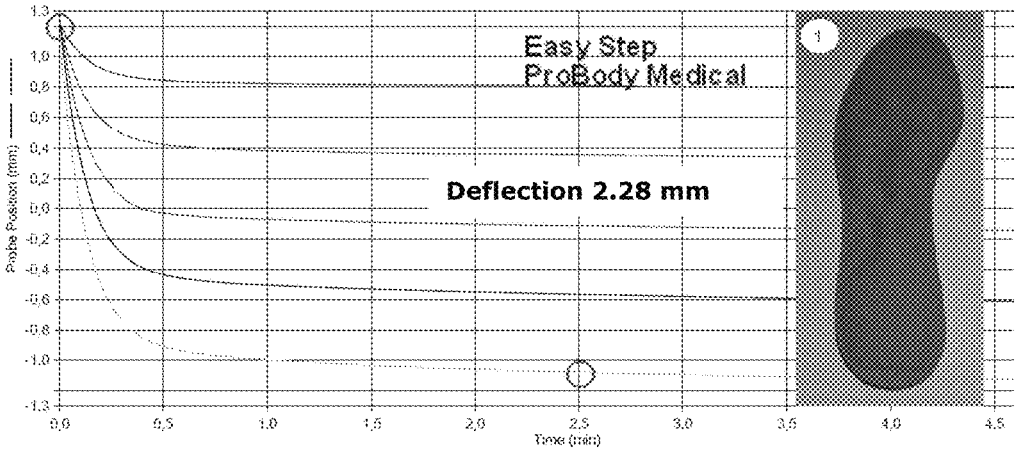
FIG. 14.1
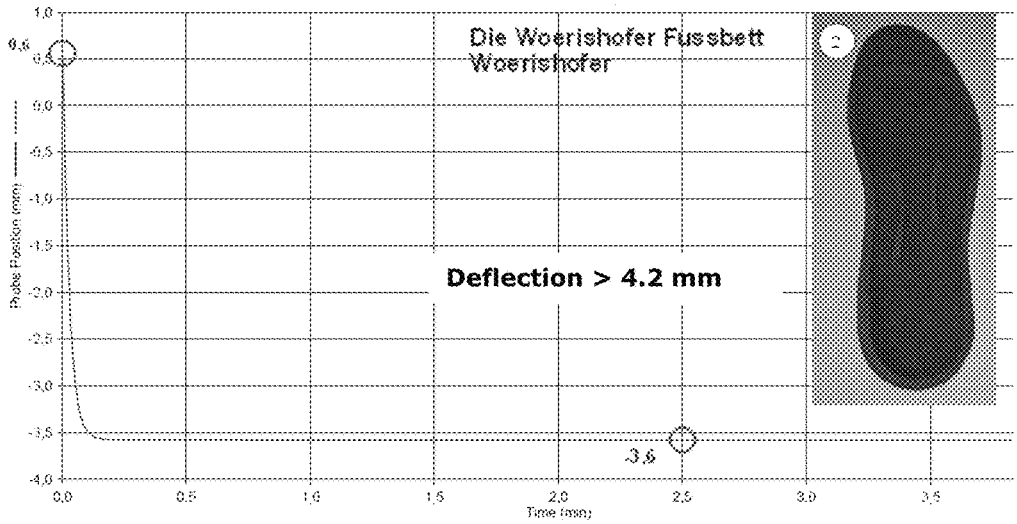
FIG. 14.2

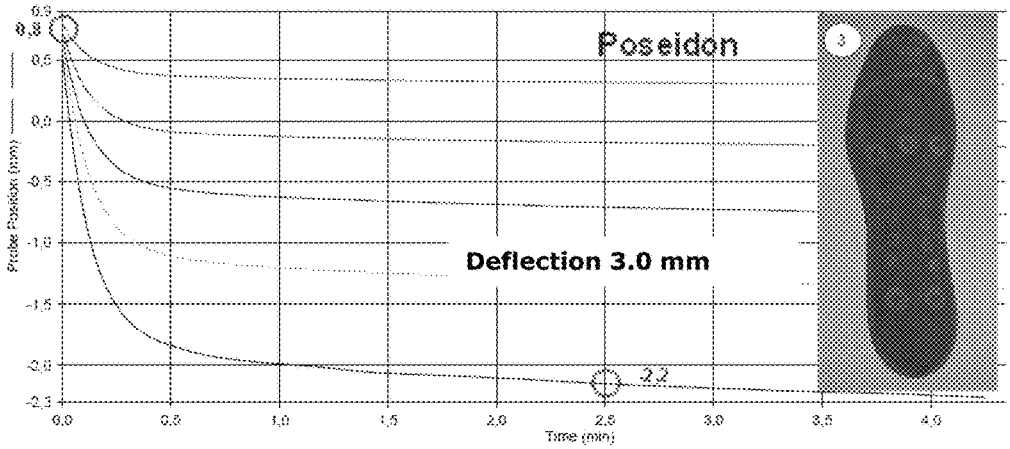
FIG. 14.3
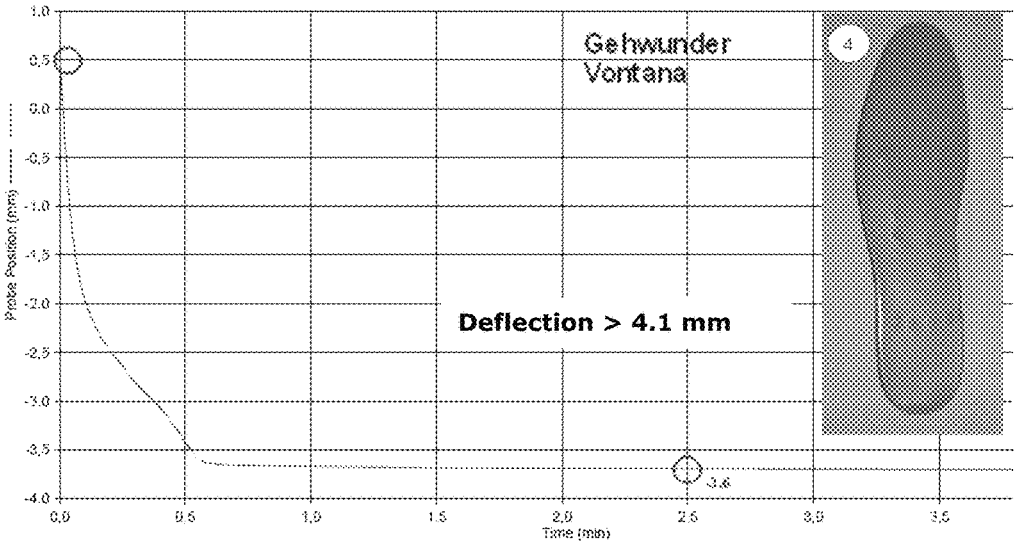
FIG. 14.4

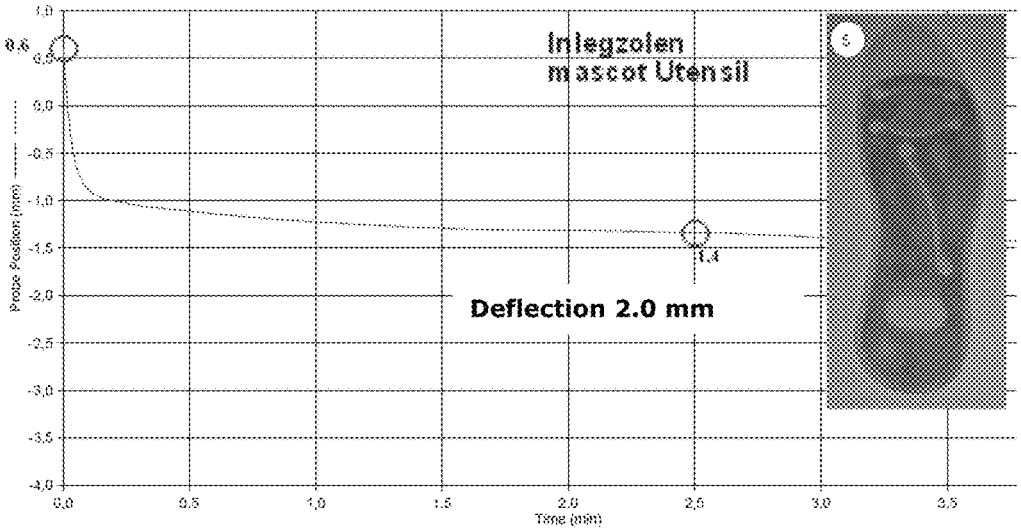
FIG. 14.5
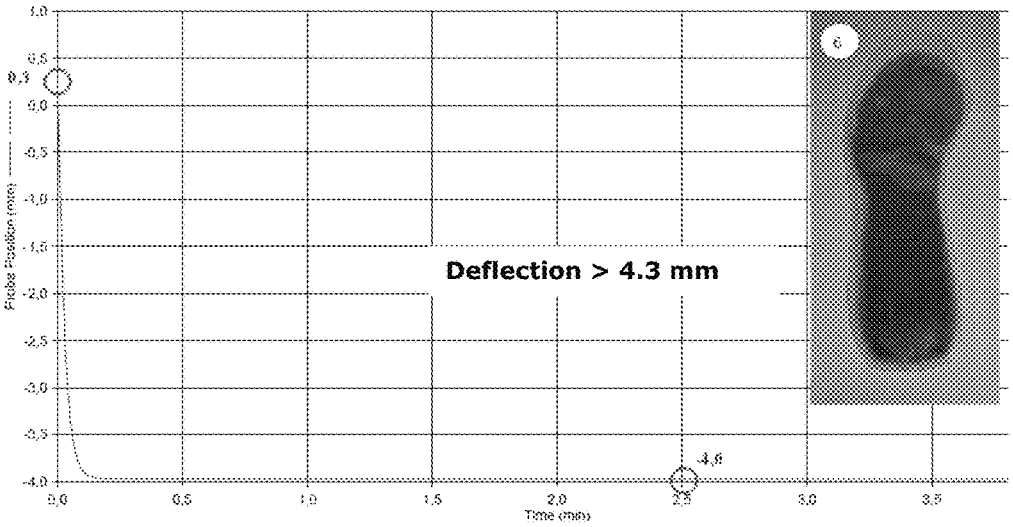
FIG. 14.6

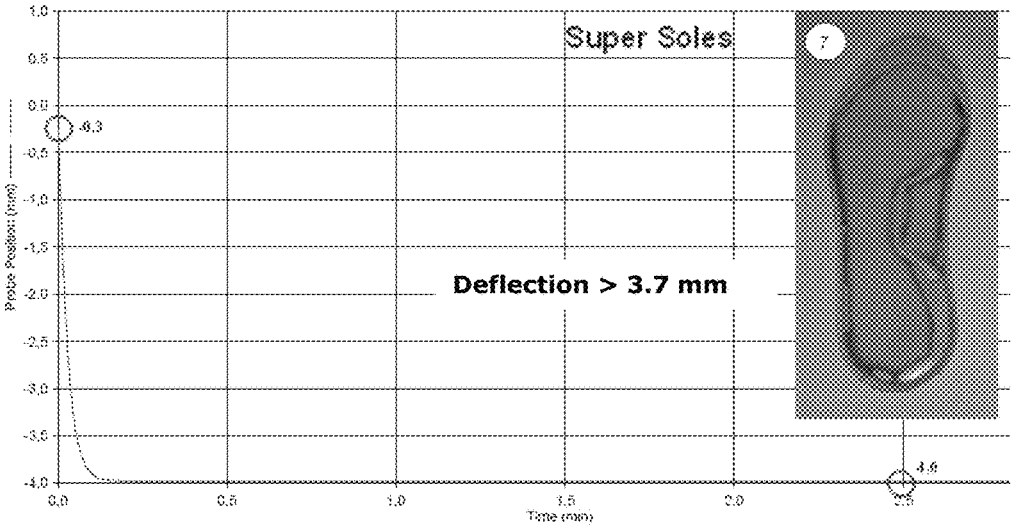
FIG. 14.7
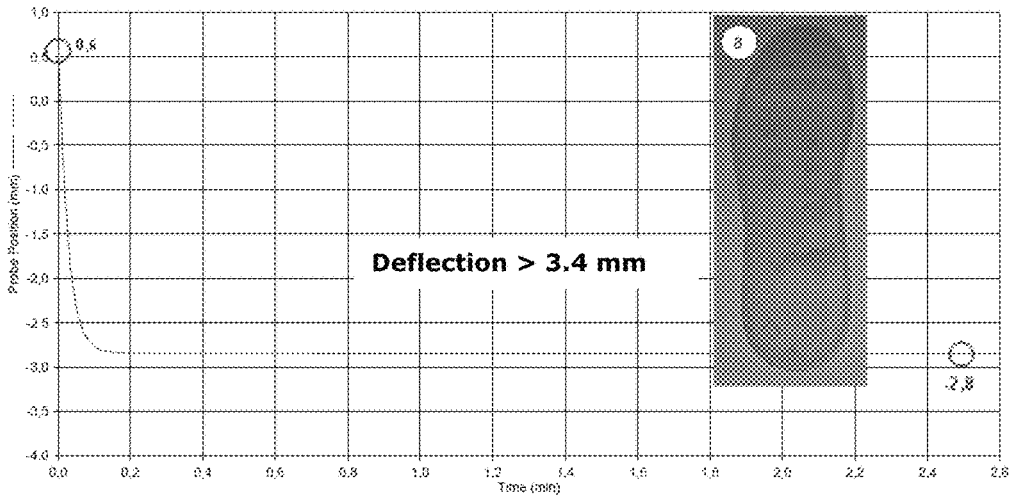
FIG. 14.8

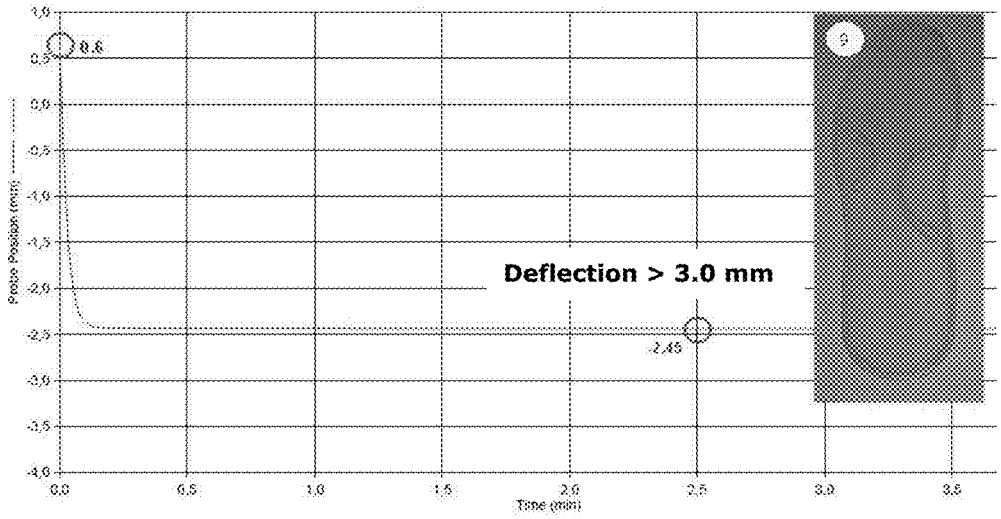
FIG. 14.9
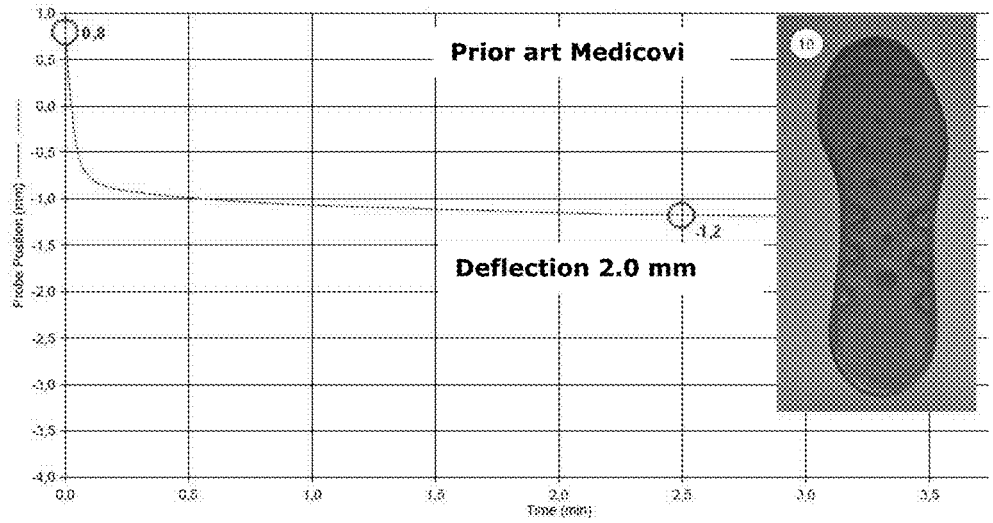
FIG. 14.10

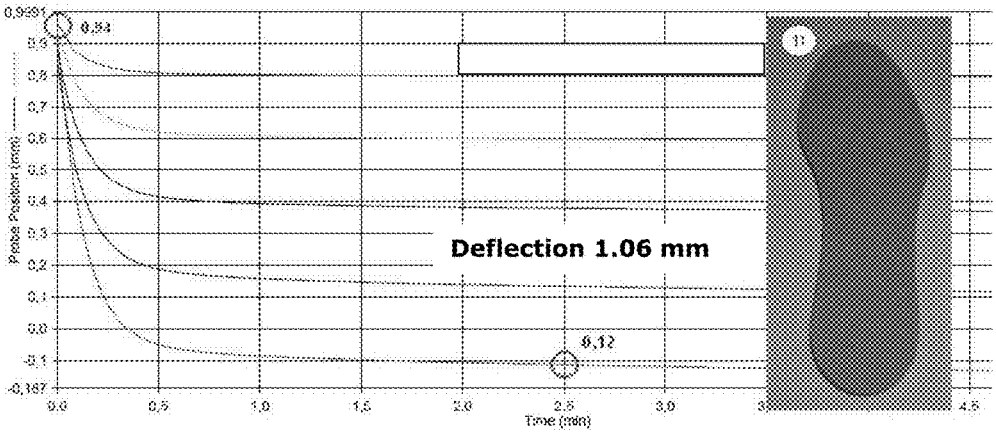
FIG. 14.11
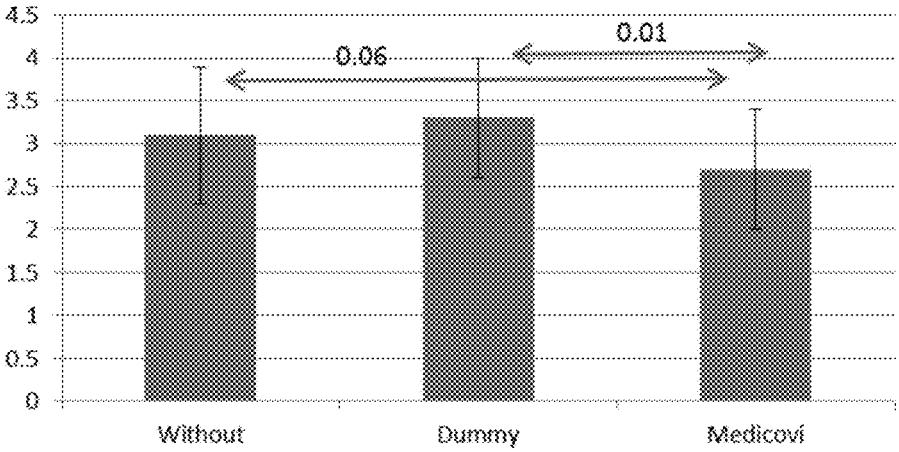
FIG. 15
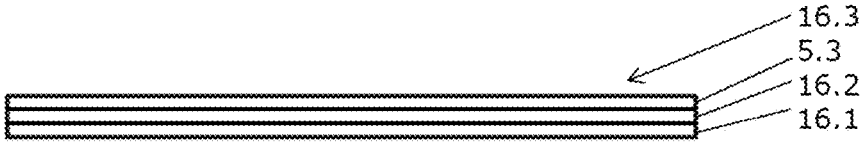
FIG. 16

BALANCE-IMPROVING LIQUID-FILLED INSOLE FOR USE IN THERAPEUTICS, REHABILITATION, STANDING AND WALKING WORK AND SPORTS

This application claims the benefit of Danish Application No. PA 2013 70812 filed Dec. 20, 2013, and PCT/DK2014/050435 filed Dec. 17, 2014, International Publication No. WO 2015/090331 A1, which are hereby incorporated by reference in their entirety as if fully set forth herein.

FIELD OF THE INVENTION

The present invention relates to liquid-filled insoles. In particular, it relates to an insole for footwear, wherein the insole comprises a lower membrane foil and an upper membrane foil that are mutually joined along a closed path, for example along the edge region, for example by welding, for thereby forming a closed space, wherein the space is filled with liquid. The invention also relates to the use of such insole in a shoe suitable during therapeutics, rehabilitation, walking and standing work and sports, such as golf sport.

BACKGROUND OF THE INVENTION/DESCRIPTION OF PRIOR ART

There are disclosed a number of fluid-filled insoles, for example in European Patent EP1891869 and U.S. Pat. Nos. 6,665,959, 6,865,823, 7,013,584 and 7,243,446 by Vindriis. These insoles are made of a relatively soft material. The reason for using soft highly elastic plastic foils is that these foils by means of the hydraulic pressure of the liquid allow the insoles to form a large surface against the foot, so as to maximize comfort and pain relief.

In order to increase the ability of insoles to distribute the weight evenly across the foot, it is proposed in U.S. Pat. Nos. 5,878,510, 6,138,382, and 6,178,663 by Schoesler to use a highly viscous liquid and constricted passages for achieving a slow flow of the liquid in the insole. Water is explicitly disclosed as considered unsuitable for such insoles. As material for the insole, polyurethane is preferred, although, other materials are considered useful, such as EVA (ethylene vinyl acetate), polyvinyl chloride (PVC) or vinyl.

A viscous liquid with a viscosity between water and honey in an insole is proposed in German patent publication DE19522100 by Jürgens. As a preferred material for the foil of the insole, soft weldable PVC is disclosed.

Shock absorption is also the objective in International patent application WO2013/006393, which, however, proposes a micro-particulate medium in a reservoir that is attached to a sole made of polymer foam.

In all the above insoles, the distribution of load from one to another part of the foot is the primary objective, why the sole materials are selected as relatively soft highly-elastic plastic foils. Moreover, soft polymer has the further advantage that it is suitable for high-frequency welding, which is a preferred method of attaching the foils to one another along the edge.

Although, the above soles are good for weight distribution generally by distributing foot load over a larger area, the effect on nerve stimulation for improving the ability for balance is very small. Loss of balance ability, however, is a very big problem in connection with a number of diseases such as multiple sclerosis, Parkinson's disease, diabetes, heart stroke, etc., but also in relation to the possibility of elderly to help themselves. It is presumed that an improvement of the balance ability improves the conditions in the above diseases. In this connection, it must be recalled that foot injuries are very common, especially, in diabetes, and the total costs for treatment are considerable.

It is therefore desirable to provide new means for increasing balance.

DESCRIPTION OF THE INVENTION

It is the objective of the invention to provide new means for improving the balance for people, and generally to provide an improvement in the art. It is in particular an objective to provide a liquid-filled insole for increasing a person's balance ability. This objective is achieved with an insole as described in the following.

The balance improving insole according to the invention is built up by two membrane foils, of which at least one has a very low elasticity and high stiffness, in between which there is provided a low viscosity liquid, typically water. The result is that the insole reacts extremely fast to load changes by flow of the liquid from one area of the foot to another area of the foot. Thereby, the balance response gets faster for a person using such insoles.

It has been found that improvement of the balance reduces the load on the foot sole and increases the blood circulation in the foot and the foot sole. This is a great advantage for diabetes patients, for which the balance improving insole also has a great advantage of preventing neuropathy. For multiple sclerosis patients and in rehabilitation after stroke, such insoles have also turned out to be very advantageous. Furthermore, improved balance for people with standing and walking work results in less tired-ness. For athletes, for example, in golf and running sports, there has been observed a better performance when using such insoles.

Specifically, the insole comprises a lower membrane foil and an upper membrane foil mutually joined along a closed path, for example along the perimeter, so as to form a closed volume, wherein the volume is filled with a low viscosity liquid, typically water. The upper membrane foil, or both the upper membrane foil and the lower membrane foil, is produced with a relatively high membrane strength and in a plastic material, for example a plastic laminate that is relatively stiff as compared to the otherwise relatively soft fluid filled insoles of the prior art. In comparison to the liquid-filled insoles of the prior art, a relatively small deflection would be achieved in a bending measurement. The term "relatively stiff" and "relatively small deflection" is defined in the following with reference to a simple and practical method of bending measurement.

The bending measurement is made with a piece of 10 mm×25 mm of either the upper foil or the lower foil of the given liquid-filled insole. The piece is placed centrally on two parallel rails having a spacing of 15 mm so that there are 15 mm or approximately 15 mm space between the supports of the foil. At a temperature of 25° C., a force is applied on the piece of foil in the middle between the two rails, corresponding to a weight of 25 g, thereby causing a deflection of the piece of foil. It is measured after 2.5 minutes constant application of weight. The above criterion of "relatively stiff" or "relatively small deflection" is defined by the deflection being less than 1.95 mm by this method of measurements, for example less than 1.5 mm. It should be noted that the upper membrane foil or both the upper membrane foil and the lower membrane foil should not be too stiff, why the stiffness should be such that the deflection is typically larger than 0.2 mm, for example more than 0.5 mm. However, in certain cases, as explained below, especially for sports purpose, the stiffness is advantageously higher, thus, leading to a minimum limit for the deflection of 0.02 mm. Thus, the criteria for a stiff insole relatively to the prior art is a balance-improving deflection interval of 0.02 mm to 1.95 mm, for example 0.02 mm to 1.5 mm or 0.2 mm to 1.95 mm, such as 0.2 mm to 1.5 mm.

The upper membrane foil and the lower membrane foil may be made with the same stiffness or with different stiffness. For example, the insole is provided with an upper membrane foil that has a higher stiffness than the lower membrane foil. As especially the rapid distribution of pressure against the foot is important, it is especially advantageous to provide a high stiffness in the upper membrane foil. On the other hand, a softer lower membrane foil may be advantageous in connection with good shock absorption, for example, when used in running shoes. By providing an upper membrane foil in a stiff material, i.e. with a stiffness within the specified balance-improving deflection interval as stated above, and a lower membrane foil that is softer i.e. with a lower stiffness, for example, outside of the specified balance-improving deflection interval, a combination is obtained for improving the balance by the stiff upper membrane foil and good shock absorption by the soft lower membrane foil.

In some embodiments, there is provided an upper membrane foil having a stiffness corresponding to the above balance-improving deflection interval, and the lower membrane foil has a lower stiffness than the upper membrane foil. This stiffness of the lower membrane foil can in principle be outside the above specified deflection interval. Alternatively, it is within the same range but with a greater deflection than the upper membrane foil, for example, between 0.8 mm and 1.95 mm, and whereas the upper membrane foil has a stiffness corresponding to a deflection of between 0.02 and 0.8 mm or between 0.2 and 0.8 mm.

The insole should preferably not be too thick because of space constraints in the shoes, so it is an advantage that the upper membrane foil or both the upper membrane foil and the lower membrane foil each have a foil thickness of less than 1.5 mm, for example, less than 1 or 0.8 mm. Variants of the finished insole may, for example, have a total thickness of less than or equal to 10 mm, preferably less than 6.5 mm, or even less than 6 mm.

In the production of insoles, it is appropriate to manufacture the reservoir for the liquid, for example water, by high-frequency welding, for example along an edge region. High-frequency welding may also be used to provide flow constrictions in the reservoir. Unfortunately, the materials that can be high-frequency welded satisfactory, for example, polyurethane, PVC or EVA, do not have a stiffness that is sufficient for the purposes indicated here, when the foil thickness is less than 1.5 mm, for example less than 1 mm. In order to achieve the desired stiffness, even for thin foils, in some embodiments, a laminate is used in which a material with good high-frequency welding capabilities is laminated with a stiff material with less good of such capabilities or which cannot be high-frequency welded, at all. The softer side of the laminate is then used to form the liquid reservoir, because a good seal is obtained with a long life time by high-frequency welding, while the hard/stiff foil is provided on the opposite side and is not required to be welded to seal the reservoir. The stiff foil must be attached on the soft foil by a suitable lamination technique without high-frequency welding. There can be used, for example, gluing or other techniques using heat to fuse by melting In some practical embodiments, the material of the upper membrane foil or both the upper membrane foil and the lower membrane foil are constructed as laminates consisting of a film of polyurethane (PU) laminated with a film of polyamide (PA, nylon), polyethylene (PE), or polypropylene (PP) or mixtures thereof. There may also be provided a cover of polyester fibers and/or cotton fibers, either woven or non-woven. Other plastics and fiber materials may also be used.

As high-frequency weldable material, polyurethane (PU) is useful. However, there may also be used ethylene vinyl acetate (EVA), polyvinyl chloride (PVC), or polyvinylidene chloride (PVdC)

As foil for increasing the stiffness, the following foil materials are particularly useful: polyethylene vinyl acetate (PEVA), polyethylene (PE) and polypropylene (PP), all of which are excellent water barriers and tough materials. Oriented poly amide (OPA) or polyamide (PA), also known as nylon, provides a high strength.

The following combinations have proved to be very advantageous:

PU-PEVA
PU-PE
PU-PEVA-PA
PU-PEVA-PA-PEVA
PU-PEVA-PA-PE-PEVA
PU-PEVA-PA-PP-PA-PEVA
PU-PE-OPA-PP-PA-PEVA

In these combinations, the high-frequency weldable PU foil layer is optionally replaced by EVA, PVC or PVdC.

The outer layer may furthermore be strengthened against creep and be provided with a comfortable surface by adding a fabric layer of polyester and/or cotton in the form of a fabric that is woven or non-woven.

At certain concentration levels of vinyl acetate, polyethylene vinyl acetate (PEVA) may also be high-frequency welded. However, it is herein preferred that the used PEVA is of a type having a stiffness and nature such that it is not suitable for high-frequency welding.

Typically, the lower membrane foil and the upper membrane foil are mutually joined along the edge to thereby form the enclosed space for the liquid. Furthermore, the joint comprises several local constrictions in the joints along the right or left edge of the insole or at both the right and left edge such that the width of the enclosure varies alternating.

For example, the constrictions are provided only at the right edge or only at the left edge of the insole, so as to create an asymmetric flow profile of the liquid that follows the normal type of load by the foot. As an alternative, the constrictions are provided at both the right and left side of the insole. An asymmetric flow profile that follows the foot's normal form of load is provided by the shape, number and/or size of the constrictions at the right edge being different from shape, number or size of the constrictions at the left edge.

In some embodiments, the insole includes an electrical conductor in order to counteract static electricity.

Advantageously, the insole comprises a functional upper part, comprising at least one of the following:

- Recesses and pressure-relieving or shock absorbing plates in the recesses;
- Local elevations for supporting the arch and forefoot, or both;
- Fasteners for attaching plural single elements, where each single element constitutes a local elevation to support the arch or forefoot, or both;
- A multi-layer comprising a foamed pressure-relieving material, a textile on top of the foamed material, and on top of the fabric a net or multiple nets with different mesh sizes for the ventilation of the foot sole.

Advantageously, the insole comprises a functional lower part, which comprises at least one of the following:

A liquid-filled shock and pressure relieving Heel Protector

A heel protector of solid shock absorbing material

Typically, the upper membrane foil and the lower membrane foil are joined by welding, especially high-frequency welding, although in principle it is also possible to glue the foils together.

Typically, the liquid in the enclosure is water. However, other low-viscous liquids can be used as well. For example, the viscosity of the liquid inside the enclosure is less than 110% of the viscosity of water. Alternatively, the viscosity is equal to or less than the viscosity of water.

For example, a method of manufacturing an insole according to the above is obtained by providing a first polymer foil that is high-frequency weldable, and a second polymer foil having a higher stiffness than the first polymer foil. The first polymer foil and second polymer foil are laminated together, thereby forming a laminate for an upper membrane foil. There is further provided a high-frequency weldable lower membrane foil, which is welded together with the upper membrane foil by high-frequency welding so as to form a closed space which is filled with water. The first polymer foil of the upper membrane foil is oriented towards the closed space for high-frequency welding, and the second polymer foil is oriented in a direction away from the closed space. Typically, the second polymeric foil is not suitable for high-frequency welding.

The lower membrane foil is high-frequency weldable in that it comprises a high-frequency weldable polymer foil. In order to increase the stiffness, the lower membrane foil is, in some embodiments, provided as a laminate of a polymer foil that is high-frequency weldable and a stiffer polymer foil that does not need to be high-frequency weldable, and typically will not be high-frequency weldable. For example, the laminate may be provided in the same manner and with the same foil combinations as explained in connection with the upper membrane foil.

The term "within the deflection interval" means a deflection of a length between the endpoints of that interval. For endpoints of an interval, these are optionally included.

BRIEF DESCRIPTION OF THE DRAWING

The invention is described in more detail with reference to the drawing in which FIGS. 1.1-1.2 illustrate a balancing cycle, where FIG. 1.1 is a sequential explanation of the cycle, and FIG. 1.2 illustrates the amplitudes and frequencies of sway in relation to the load on the sole of the foot;

FIGS. 3.1-3.5 show different embodiments of insoles, wherein FIG. 3.1, 3.2., FIG. 3.3, and FIG. 3.4 have different shapes, and where FIG. 3.5 is an illustration of a foot with load area;

FIGS. 4.1-4.4 illustrate the interaction between the liquid and the rigid membrane foil; where FIG. 4.1 illustrates a response of the sole with applied load; FIG. 4.2 illustrates the flow in the liquid reservoir of a stiff sole, FIG. 4.3 illustrates the reaction of a soft sole in contrast to a stiff sole, FIG. 4.4 illustrates movement of liquids in a soft sole in contrast to a stiff sole;

FIGS. 5.1-5.3 illustrate an insole with a textile surface, wherein FIG. 5.1 shows the structure of textile directly on the liquid reservoir, FIG. 5.2 shows the structure of a pressure-relieving soft material, FIG. 5.3 shows the structure with a ventilation layer on the surface;

FIGS. 7/1-7.2 illustrate a liquid-filled insole with a functional upper part that is provided with cavities with pressure-relieving or shock-absorbing plates either as part of the sole, which is illustrated in FIG. 7.1, or separately for insertion, as illustrated in FIG. 7.2;

FIGS. 9.1-9.2 illustrate the attachment mechanism of a functional upper part to the liquid-filled reservoir;

FIG. 10 illustrates a liquid-filled insole with a functional upper part molded in elastomer;

FIGS. 11.1-11.2 illustrate an insole of FIG. 11.1 is a perspective view and in FIG. 11.2 in cross-section, which is laterally wrapped with an electrically conductive ribbon, and where there is shown an insole with a friction-generating bottom;

FIGS. 12.1-12.2 illustrate an insole that has imposed an additional Heel Protector under the heel, wherein FIG. 12.1 illustrates the operation, and FIG. 12.2, is a particular embodiment;

FIGS. 13.1-13.3 illustrate how the insole can improve a golfer's balance, in which FIG. 13.1 is with an insole according to the invention and FIG. 13.2 is with a plain sole in golf shoes; FIG. 13.3 illustrates the sway with the respective insoles;

FIGS. 14.1-14.11 show measurements as explained according to FIG. 3 with polymer foils, of which FIG. From 14.1 to 14.10 are fluid filled insoles commercially available on the market and in which FIG. 14.11 are measurements from an insole according to the invention;

FIG. 15 shows experimental results from a study of users of the invention; FIG. 15.1 are experimental data demonstrating the improvement of the balance system, and FIG. 15.2 shows experimental results from rehabilitation of a group of elderly after stroke;

FIG. 16 illustrates a laminate for an insole.

DETAILED DESCRIPTION OF THE INVENTION

Brief Description of the Drawing

Figure 2:
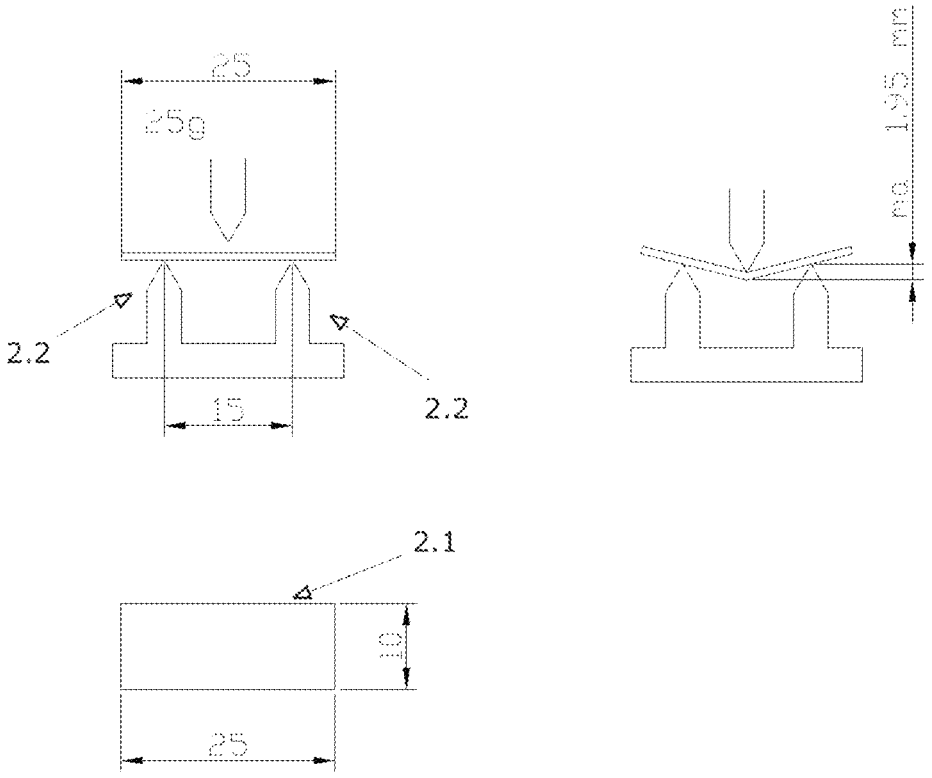
FIG. 2 illustrates the measuring device for the measurement and definition of stiffness.
Figure 6:
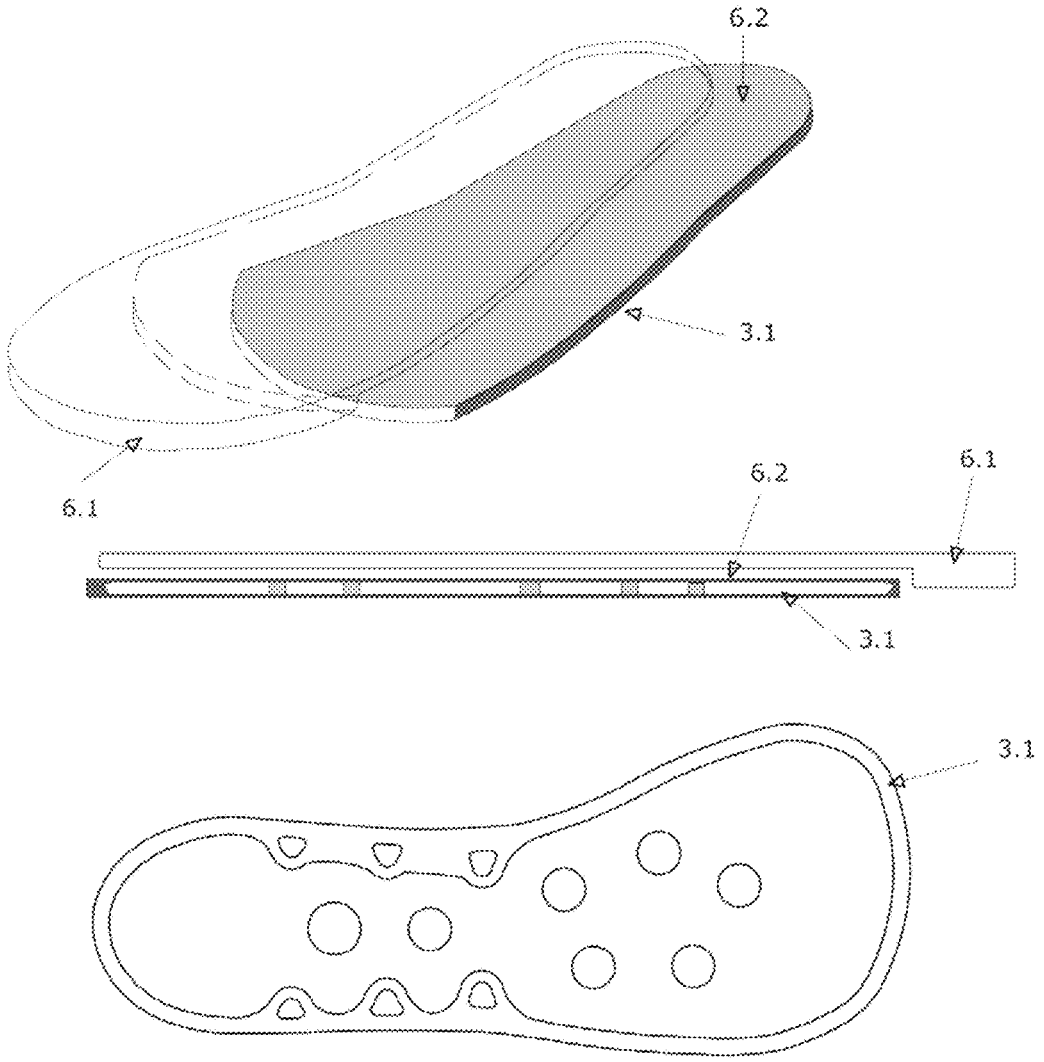
FIG. 6 illustrates a liquid-filled insole with functional upper part.
Figure 8:
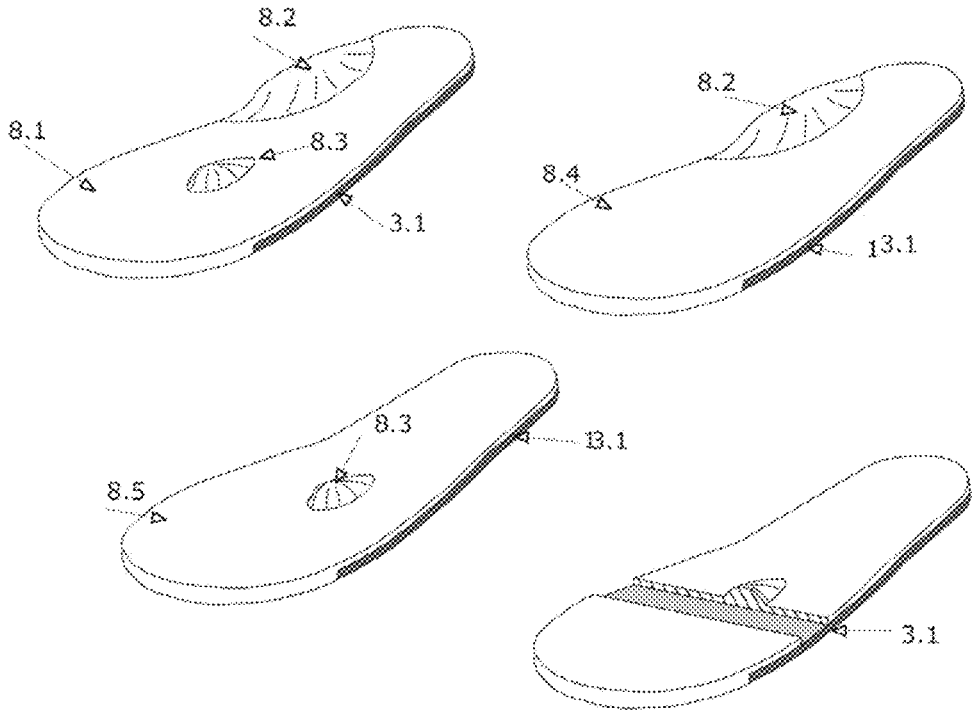
FIG. 8 illustrates a liquid-filled insole with functional upper part with supporting elevations.

The invention is described in more detail with reference to the drawing in which FIG. 1 illustrates a balancing cycle, where FIG. 1.1 is a sequential explanation of the cycle, and FIG. 1.2 illustrates the amplitudes and frequencies of sway in relation to the load on the sole of the foot;

FIG. 2 illustrates the measuring device for the measurement and definition of stiffness;

FIG. 3 shows different embodiments of insoles, wherein FIG. 3.1, FIG. 3.2., FIG. 3.3, and FIG. 3.4 have different shapes, and where FIG. 3.5 is an illustration of a foot with load area;

FIG. 4 illustrates the interaction between the liquid and the rigid membrane foil; where FIG. 4.1 illustrates a response of the sole with applied load; FIG. 4.2 illustrates the flow in the liquid reservoir of a stiff sole, FIG. 4.3 illustrates the reaction of a soft sole in contrast to a stiff sole, FIG. 4.4 illustrates movement of liquids in a soft sole in contrast to a stiff sole;

FIG. 5 illustrates an insole with a textile surface, wherein FIG. 5.1 shows the structure of textile directly on the liquid reservoir, FIG. 5.2 shows the structure of a pressure-relieving soft material, FIG. 5.3 shows the structure with a ventilation layer on the surface;

FIG. 6 illustrates a liquid-filled insole with functional upper part;

FIG. 7 illustrates a liquid-filled insole with a functional upper part that is provided with cavities with pressure-relieving or shock-absorbing plates either as part of the sole, which is illustrated in FIG. 7.1, or separately for insertion, as illustrated in FIG. 7.2;

FIG. 8 illustrates a liquid-filled insole with functional upper part with supporting elevations;

FIG. 9 illustrates the attachment mechanism of a functional upper part to the liquid-filled reservoir;

FIG. 10 illustrates a liquid-filled insole with a functional upper part molded in elastomer;

FIG. 11 illustrates an insole of FIG. 11.1 is a perspective view and in FIG. 11.2 in cross-section, which is laterally wrapped with an electrically conductive ribbon, and where there is shown an insole with a friction-generating bottom;

FIG. 12 illustrates an insole that has imposed an additional heel protector under the heel, wherein FIG. 12.1 illustrates the operation, and FIG. 12.2, is a particular embodiment;

FIG. 13 illustrates how the insole can improve a golfer's balance, in which FIG. 13.1 is with an insole according to the invention and FIG. 13.2 is related to a plain sole in golf shoes; FIG. 13.3 illustrates the sway with the respective insoles;

FIG. 14 shows measurements as explained according to FIG. 3 with polymer foils, of which FIG. 14.1 to FIG. 14.10 are fluid filled insoles commercially available on the market and in which FIG. 14.11 are measurements from an insole according to the invention;

FIG. 15 shows experimental results from a study of users of the invention with experimental data demonstrating the improvement of the balance system;

FIG. 16 illustrates a laminate for an insole.

DETAILED DESCRIPTION OF THE INVENTION

The balance-improving insole according to the invention is built up of two membrane foils with very low elasticity and high stiffness, between which a liquid is provided in a reservoir. An example is shown in FIG. 3.1. The insole 3.1 consists of a lower membrane foil 3.2 and an upper membrane foil 3.3 joined along the edge 3.4, for example, welded such that there is provided an enclosure 3.5. On the insole area, a number of traversing joints 3.6, typically welds, are provided which connect the lower membrane foil 3.2 with the upper membrane foil 3.3 and act as flow regulators. In the enclosure 3.5, a suitable amount of liquid is 3.7 provided such that load on the insole causes a hydraulic pressure in the liquid, which propagates along the enclosure 3.5.

FIG. 2 shows how the stiffness of the membrane foils is measured and defined. The following measuring equipment is applied: Parallel Plate Measuring Systems DMA 7E, Dynamic mechanical analyzer, Bending Measuring Systems by PerkinElmer, USA. For a description of the system, see the Internet sites:

http://www.perkinelmer.com/Catalog/Category/ID/Bending%20Measuring%20Systems%20for%20DMA-%207E and http://www.perkinelmer.com/Catalog/Category/ID/Parallel%20Plate%20Measuring%20Systems%20for-%20DMA%207E.

This measurement system is standard for such measurements and commercially available. It is generally used for comparison, and results thereof are well-defined, in particular relative measurements when materials are compared.

A section 2.1 is provided of the lower membrane foil or the upper membrane foil, hereinafter generally referred to as the membrane foil, wherein the section is 25 mm×10 mm. The section 2.1 of the membrane foil is placed centrally on the two parallel supports 2.2 of the measurement device, the supports having has a distance of 15 mm. Then, a load of 25 g is applied centrally to the section 2.1 of the membrane foil for 2.5 minutes at 25° C.; and the maximum acceptable deflection of the membrane foil is 1.95 mm. If the deflection of the membrane foils is more than 1.95 mm, the balance-improving effect of the membrane foil is significantly reduced and defined as too low.

It is particularly the stiffness of the membrane foils that is essential for the balance-improving property. The thickness of the membrane foils is only significant in relation to the space that the finished insole takes up inside shoes, however, the membrane foils still need to have a certain degree of elasticity. If the stiffness in relation to the measurement method in FIG. 2 is so large that the deflection by the measurement is less than 0.02 mm, the effect balance-improving be greatly reduced and not sufficient. In some cases, the lower limit of 0.2 mm applies, though. Thus, it is necessary to have a stiffness which by the measurement method leads to a deflection of between 0.02 mm and 1.95 mm, for example between 0.2 mm and 1.95 mm, optionally between 0.02 mm and 0.5 mm, or between 0.5 mm and 1.5 mm.

From FIG. 1.1 it appears that the balance system consists of a motoric system and a sensory feedback.

The will power for movement is effectuated via motoric information transmitted to the muscles that are desired activated for the specific movement. Any movement is detected by the sensory feedback from the four balance oriented domains, which are the sensory nerves of the feet, the relative angle of the joints, the balance center of the ear, and the orientation by the eye. The sensory feedback gives continuously rise to the correction of the actual motoric information about the movement.

As illustrated in FIG. 4, it is the interaction between the liquid 4.3 and the membrane foils 4.1 and 4.2 that causes the unique balance improving property of the insole according to the invention. With reference to FIG. 4.1, it is the body sway that entails the varying load k, by which the surface of the insole 4.1 is pressed downward a vertical distance t. When the load k affects the membrane foil 4.1, the surface pressure on the liquid is large due to the stiffness of the membrane foil 4.1, because the pressure is distributed over a relatively large area of the liquid due to the stiffness. Despite a very small value of t, there will occur a very large hydraulic pressure P in the liquid, which, due to membrane foils stiffness, will propagate with great speed v in the entire sole and with a force P' against the sole of the foot. The latter is illustrated in FIG. 4.2. Accordingly, the foot's sensory nerves are effected by the constantly varying force P' over the whole area by which the sole of the foot is in contact with the surface of the insole 4.1, through which there arises an extremely rapidly intensified continuous sensory feedback to the balance system. This means that the balance system initiates the balance creating muscle activities much faster and more accurately.

FIG. 4.2 shows that membrane foils 4.1 and 4.2 due to the stiffness form the hydraulic pressure P' on a large surface area against the sole of the foot, whereby the hydraulic pressure P' can be distributed under areas of the sole 4.1 that are at a different location under the foot than the areas that are loaded by the force K.

In contrast to the relatively rigid membrane foil according to the invention, soft foils of the prior art behave quite differently. This is illustrated in FIG. 4.3 and FIG. 4.4. If the foil 4.4 is soft, i.e. it has a greater deflection than 1.95 mm at a load of 25 g for 2.5 min at 25° C. following the measurement method in FIG. 2, then, application of the force K will have to result in the foil 4.4 being pressed far down t" in order to displace a similar amount of liquid as in FIGS. 4.1 and 4.2. This will occur slower such that the prompt response is not achieved. The water thus has more time to propagate and the pressure P" is less. In particular, this pressure P" will be much smaller than P in FIG. 4.1 at the same value t" as depression t, because the soft material does not cause the same displacement as in FIG. 4.1.

Experimentally, with the above procedure, a limit has been found for the maximum deflection of 1.95 mm, for example 1.95 mm as indicated in FIG. 2. That means that the insoles are considered as too soft if the foil is deflected by more than 1.95 mm. An alternative maximum deflection value is 1.5 mm and the stated intervals read with this as the maximum deflection value.

In addition, because of the softness, the foil will fold outwards 4.4, as shown in FIG. 4.4 if the foil 4.4 is loaded with hydraulic pressure K. Soft foils cannot generate the necessary hydraulic pressure with the necessary rapid propagation and the area which are necessary for sensory nerves of the foot being able to generate a sensory feedback that can have a significant impact on the balance.

The balance, however, also has a very large impact on the foot sole's bearing capacity, because a poor balance automatically lead to an inappropriate load on the foot's bearing cells as a result of the greater sway. FIG. 1.2 illustrates that a larger sway implies that a larger load is put on the supporting tissue in the loaded part of the foot sole. Thus, the load on the bale or the forefoot is less by a sway as shown by position 1.1 than by a sway as shown as position 1.2. At the same time, a larger sway prolongs the time in which this greater load affects the tissues, partly because the sway lasts longer and partly because it takes longer to stop the larger inertia resulting automatically from the larger sway. This means that the supporting tissue of the foot sole in the loaded area of the foot surface is pressed more together so that the blood supply is reduced or entirely blocked. Thereby, the supporting cells are cut off from their energy sup-plies for longer periods This load form exhausts the cells, resulting in fatigue and subsequent pain.

Conversely, good balance implies that the load on the supporting cells become more evenly distributed, while the energy supply to the supporting cells only gets blocked for short periods, providing a better energy supply to the cells, by which they are able to maintain their carrying capacity for a considerably longer time, while at the same time, a better blood circulation is achieved by the blood being blocked less.

FIG. 3 shows different designs of an insole 3.1 according to the invention. The insole 3.1 comprises a lower membrane foil 3.2 and an upper membrane foil 3.3 welded, especially high-frequency welded, or glued together along the edge 3.4, thereby creating an enclosure 3.5. On the surface of the insole, a number of traversing joints 3.6 are provided, typically welds that connect the upper membrane foil with the lower membrane foil and which act as flow regulators. The enclosure 3.5 contains liquid 3.7 such that load on the insole creates a hydraulic pressure that propagates efficiently to other parts of the insole.

In the region 3.9 in FIGS. 3.1 and 3.11 in FIG. 3.2, the liquid's flow velocity from the heel and towards the forefoot is regulated by the flow controllers 3.6 as well as constrictions in the joints, typically weldings, 3.8 in FIGS. 3.1 and 3.10 in FIG. 3.2. The constrictions may be either parallel on either side of the foot, as shown by 3.11 in FIG. 3.2 or provided asymmetrically as shown by 3.8 in FIG. 3.1. In the asymmetric embodiment 3.8, a flow arises that follows the foot's normal load form 3.12, as shown in FIG. 3.5.

FIG. 3.3 shows a further embodiment, which is provided with holes 13.3 that can be used for the attachment of various supports for the foot.

FIGS. 3.1, 3.2, 3.3, and 3.4 show in comparison that flow regulators can be designed by many different geometries 3.14. In addition, there may be placed several flow regulators in the transition between the heel and the forefoot.

On the upper side 3.16 against the foot, different functional layers can be provided. As shown in FIG. 5, such functional layer 5.2 may be laminated or glued to the insole of the invention. These functional layers 5.2 can be extremely diverse as explained below with some examples, which are not exhaustive.

FIG. 5.1 shows an embodiment giving comfort in that a fabric 5.3, for example cotton or polyester, is laminated on the surface 5.1 of the insole 3.1 according to the invention. Further, in between the fabric and the upper membrane foil, an underlying soft pressure-relieving material 5.4 can be laminated, as shown in FIG. 5.2, for example a foam material. An example of such a material is foamed polyurethane. Furthermore, above the fabric 5.3, there may be inserted in one or more net materials 5.5 with various mesh sizes for allowing outside air to ventilate the foot sole.

FIG. 6 shows an alternative embodiment in which a functional upper part 6.1 is glued to the surface 6.2 of the insole 3.1 according to the invention. This embodiments allows for a number of alternative designs. Although, the support of the arch will be higher, the functional upper part 6.1 as the base is typically between 2 and 6 mm thick, and will optionally be made of foamed ethylene vinyl acetate (EVA), polyethylene (PE) or polyurethane (PU) or a mixture of these materials. The upper part 6.1 can also be provided anti-bacterial to counteract diseases, in particular for people with diabetes. Additionally or alternatively, the surface may be provided antistatic, especially for safety shoes.

FIG. 7.1 shows a further embodiment where the functional upper part 7.1 is provided with cavities under the heel 7.2 and forefoot 7.3 where specifically pressure-relieving or cushioning plates 7.4 and 7.5 are inserted for more pain relief or cushioning. In special balance-demanding cases, the plates 7.4 and 7.5 may be made of very hard plates whose hardness is close to its metal, for example steel plates.

FIG. 7.2 shows a further configuration of the functional upper part 7.6 for the insole of the invention 3.1. The functional upper part 7.6 is provided with recesses 7.2 and 7.3, and pressure-relieving or shock-absorbing plates 7.7 and 7.8 are supplied separately, thereby allowing individual adjustment of the insole to the specific needs of an individual. The pressure-relieving or shock-absorbing plates 7.7 and 7.8 can in this embodiment be adapted to the patient's specific pain problems, for example by providing a recess 7.9 in the plate 7.8. Subsequently, the pressure-relieving or shock-absorbing plate 7.8 with recess 7.9 can be mounted in the cavity 7.5 in the functional upper part 7.6; likewise, the pressure-relieving or shock-absorbing plate 7.7 can correspondingly be mounted in the cavity 7.4 in the functional upper part 7.6. Afterwards, the upper part 7.6 with the mounted pressure-relieving or shock-absorbing plates 7.7 and 7.8 can be assembled with in the insole 3.1 according to the invention such that there appears the patient-customized insert 7.10.

FIG. 8 shows a further embodiment of the functional upper part, where the functional upper part 8.1 is molded with a foot-regulating unit 8.2 for supporting the arch of the foot and a foot-regulating pelotte 8.3 for support of the forefoot. The alternative design of the functional upper part 8.4 is only provided with the foot-regulating unit 8.2 for supporting of the arch. Likewise, the alternative embodiment of the functional upper part 8.5 is only provided with the foot-regulating pelotte 8.3 for support of the forefoot.

FIG. 9.1 shows a further configuration of the functional upper part 9.2, wherein it is provided with a foot-regulating unit 9.2 for support of the arch, and a foot-regulating incorporating pelotte 9.3, for example applied by gluing.

FIG. 9.2 shows a further embodiment in which a functional unit 9.4 is mounted on the insole 3.1 for supporting the arch of the foot and a foot-regulating pelotte 9.5 for support of the forefoot. Mounting is done with fasteners 9.7 in the holes 9.6. Afterwards, leather or fabric (not shown) can be affixed to the insole side that is towards the foot.

FIG. 10 shows a further embodiment for the functional upper part 10.1, where the embodiment is molded from an elastomer or is milled out of a foamed plastics in relation to the geometry of the foot with the additional elevations 10.2 for sensory effects. Subsequently, the upper part 10.1 is glued to the insole 3.1.

FIG. 11.1 shows an embodiment in which the insole 3.1, for example transversely, is provided with an electrically conductive strip 11.1, for example made of copper, before the functional upper part 11.2 is mounted. This embodiment makes it possible to improve the insole's antistatic properties, for example such that the insole's electric resistance becomes lower than 12.5 Mohm.

FIG. 11.2 shows that the underside 11.3 of the insole 3.1 is provided with a friction-enhancing sheet 11.4.

FIG. 12.1 shows a further embodiment where an extra heel protector 12.1 is welded or glued to the insole 3.1 for further protection of the heel.

FIG. 12.2 shows a special embodiment of the heel protector 12.2, where it is composed of an upper foil 12.3 and a lower foil 12.4. The foils 12.3 and 12.4 are joined together, for example welded, along the edge 12.5. An amount of liquid is provided between the sheets 12.3 and 12.4. A subsequent joining, for example by welding, provide the heel protector 12.2 with traversing joints 7.12, resulting in an elevated pressure in the liquid 12.6. Subsequently, the heel protector 12.2 is fastened, for example welded, to the underside 12.8 of the insole 3.1. If the heel protector 12.2 is loaded with load P, a portion of the liquid will move into the interspaces 12.9 between the joints 12.7, leading to the creation of a shock-damping and dynamic pressure-relief of the heel.

FIG. 13.1 shows a measured motion profile of a foot, where a golfer was standing on an insole according to the invention and tried to put a ball in the hole on a golf course. FIG. 13.2 shows a motion profile on an ordinary sole for a golf shoe during a corresponding movement. The crucial difference is illustrated by encircled areas, see arrows, that delimit the amplitude of motion. It is clear that the sway motion is much smaller in FIG. 13.1 than in FIG. 13.2, proving impact on the balance and the resulting sway by an insole as described above and compared to a regular golf shoes. The resulting sway is illustrated in FIG. 13.3, where the left illustration corresponds to sway when using an insole as described above and a right-hand illustration with the larger sway corresponding to the use of a regular golf shoe. The better balance yields less sway.

FIGS. 14.1 to 14.10 show a series of measurements 1-10 for polymer foils of ten different commercially available liquid soles that do not possess the same beneficial properties in relation to balance improvements as an insole according to the invention. The measurements were conducted using a well-defined and well-known method with an apparatus that is commercially available and which was described above in connection with FIG. 2. The various measurements were made at a temperature of 25° C. with a load of respectively 5 g, 10 g, 15 g, 20 g and 25 g on a piece of foil having a size of 10 mm×25 mm; for the measurement with 25 grams, the deflection after 2.5 minutes is indicated.

The measurement 1 in FIG. 14.1 is implemented on an insole under the name Easy Step™, sold by the company ProBody Medical®, see also www.pro-body.dk where it reads that ProBody Medical® is managed and owned among others by Henning Schoesler, who also is listed as inventor and applicant of the U.S. Pat. No. 6,178,663. The measured insole is built up as described in the U.S. Pat. No. 6,178,663 and the same welding pattern as the insole illustrated at the front of U.S. Pat. No. 6,178,663. The thickness was measured to 1 mm. As seen from the bending measurement, the deflection is 2.28 mm, namely, the difference between the starting position of 1.2 mm of the probe and the end position of −1.08 mm.

For the other measurements 2-10, there is likewise indicated the maximum deflection. It is seen that all of the 10 commercial insoles have a deflection in the bending measurements of at least 2 mm.

In contrast thereto, similar measurements with an insole according to the invention are shown in FIG. 14.11, where the foil thickness is 0.80 mm and, hence, thinner. The insole has a membrane foil consisting of a laminate of polyurethane, polyamide, polyethylene, polyester and cotton fibers and has a stiffness that is higher in spite of smaller thickness. It is seen that the deflection was measured to 1.08 mm in contrast to the other insoles of the prior art for which the deflection was much larger.

In FIG. 15 there is shown a diagram illustrating the experimental results for the test of the invention. At Aalborg University in Denmark, 21 people participated in a test of the insole. Experiments were carried out with insoles according to the invention in addition to so-called dummy insoles, and with no insoles at all. The right column of the chart graphically illustrates standard deviations for the pressure center in the medial-lateral direction when the persons stood for 30 seconds on the left leg. It is seen that the standard deviation was statistically significantly less for a sole according to the invention. This means that the sway was reduced.

FIG. 16 shows an example of a laminate 16.3 for an insole, for example for an upper membrane foil that is also described in connection with FIG. 3. There is provided a laminate 16.3 having a first foil 16.1 that is high-frequency weldable and forms an inner surface of the reservoir. On the outer side of the first foil 16.1 in the laminate, there is provided an additional foil 16.2 of a rigid material that provides the insole its stiff character, as the high-frequency weldable foil 16.1 is softer than the additional foil 16.2, which typically is not suitable for high-frequency welding. The additional foil 16.2 may be replaced by a multilayer of different foils to provide strength. Optionally, there is laminated an outermost fabric layer 5.3 of polyester and/or cotton, for example, woven or non-woven, as also explained in connection with FIG. 5. This outer layer provides a comfortable surface and is advantageously suitable for preventing creep. Particularly suitable high-frequency weldable materials for the first foil 16.1 are polyurethane (PU), ethylene vinyl acetate (EVA), polyvinyl chloride (PVC), or polyvinylidene chloride (PVdC), or mixtures thereof. As the second foil 16.2 in order to increase the stiffness, the following foil materials are useful: polyethylene vinyl acetate (PEVA), polyethylene (PE), polypropylene (PP), oriented polyamide (OPA), or polyamide (PA), or mixtures thereof.

Figure 17:
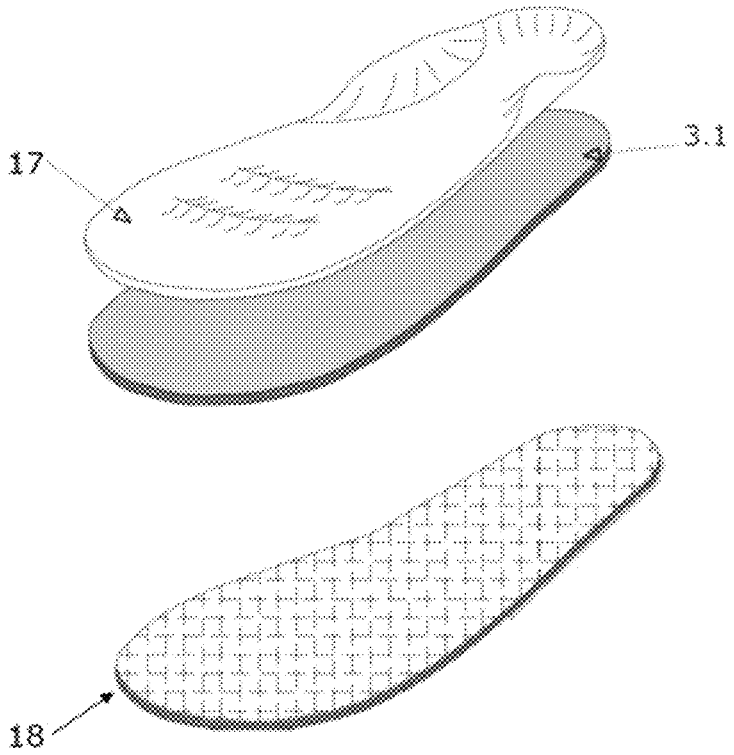
FIG. 17 illustrates a first insole.

FIG. 17 shows a first insole 17 provided on top of a top surface of the sole 18 of a sport shoe, without attachment to the top surface of the sole of the sports shoe. The first insole 17 comprises a foot bed with supporting elastic elevations below an arch area and around a heel area, wherein the foot bed is intended for contact with a foot. The insole 3.1 is inserted between the first insole 17 and the sole 18.

The invention claimed is:

1. An insole for footwear, wherein said insole comprises a lower membrane foil (3.2) and an upper membrane foil (3.3) mutually joined along a closed path so as to form an enclosure (3.5), which is filled with water; wherein only the upper membrane foil is made of a plastic material, or both the upper membrane foil and the lower membrane foil are made of a plastic material; wherein the upper membrane foil or both the upper membrane foil and the lower membrane foil has a membrane foil stiffness, wherein the membrane foil stiffness is defined by a deflection that is within a deflection interval of 0.02 to 1.95 mm; wherein the deflection is measured in a bending measurement as follows: the bending measurement is being made with a piece of 10 mm×25 mm of the plastic material placed centrally resting on two parallel rails (2.2) having a mutual distance of 15 mm, and wherein a force is applied onto the piece at 25° C., the force corresponding to a weight of 25 g midway between the two parallel rails (2,2) so as to cause a deflection after a constant weight impact for 2.5 minutes.

2. An insole according to claim 1, wherein the deflection interval is 0.2 to 1.95 mm.

3. An insole according to claim 1, wherein the material of only the upper membrane foil or of both the upper membrane foil and the lower membrane foil is a laminate.

4. An insole according to claim 1, wherein the upper membrane foil (3.3) is a laminate (16.3) of a first polymer foil (16.1) that is high-frequency weldable, and a second polymer foil (16.2); wherein the stiffness of the second polymer foil (16.2) is higher than the stiffness of the first polymer foil (16.1); wherein the first polymer foil (16.1) is oriented towards the enclosure (3.5) with the water; wherein the lower membrane foil (3.2) also comprises a high-frequency weldable polymer foil that is oriented towards the enclosure (3.5) and that is joined together by high-frequency welding with the first polymer foil (16.1) of the upper membrane foil (16.3) along the edge (3.4) to form the enclosure (3.5).

5. An insole according to claim 4, wherein the first polymer foil (16.1) is made of polyurethane (PU), ethylene vinyl acetate (EVA), polyvinyl chloride (PVC) or polyvinylidene chloride (PVdC) or a mixture thereof.

6. An insole according to claim 4, wherein the second polymer foil (16.2) is made of polyethylene vinyl acetate (PEVA), polyethylene (PE), polypropylene (PP), oriented polyamide (OPA) or polyamide (PA) or a mixture thereof.

7. An insole according to claim 1, wherein the upper membrane foil (3.3) has a thickness of less than 1.5 mm.

8. An insole according to claim 1, wherein the upper membrane foil (3.3) has a stiffness corresponding to a deflection of 0.02 to 0.5 mm.

9. An insole according to claim 1, wherein the lower membrane foil (3.2) has a lower stiffness than the upper membrane foil (3.3).

10. An insole according to claim 9, wherein also the lower membrane foil (3.2) is provided with a stiffness within the deflection interval.

11. An insole according to claim 10, wherein the lower membrane foil (3.2) has a stiffness corresponding to a deflection of between 0.5 mm and 1.95; and the upper membrane foil (3.3) has a stiffness corresponding to a deflection of less than 0.02 to 0.5 mm.

12. An insole according to claim 1, wherein the lower membrane foil (3.2) and the upper membrane foil (3.3) are mutually joined together along the edge (3.4) so as to form the enclosure (3.5) for the liquid; where the joint comprises several local constrictions (3.8) (3.10) in the joints along the insole's right or left edge or along both the right and left edge so that the width of the enclosure varies alternatingly.

13. An insole according to claim 12, wherein, for an asymmetric flow profile, the constrictions are provided only at the right edge or only on the left edge of the insole, or constrictions are provided at both right and left side of the insole, but the shape, number, or size of the constrictions at the right edge is different from the shape, number, or size of the constrictions at the left edge.

14. An insole according to claim 1, wherein the insole comprises an electrical conductor for counteracting static electricity.

15. An insole according to claim 1, wherein said insole comprises a functional upper part which comprises at least one of the following:

Recesses or shock absorbing plates in recesses;

Local elevations for supporting the arch and forefoot, or both;

Fasteners for attaching a plurality of single elements, where each single element represents a local elevation for supporting the arch or forefoot, or both;

A multi-layer comprising a foamed pressure-relieving material, a textile on top of the foamed material, and on top of the fabric a net material or multiple nets with different mesh sizes for the ventilation of the foot sole.

16. An insole according to claim 1, wherein said insole comprises a functional lower part that comprises at least one of the following:

a liquid-filled shock-relieving and pressure-relieving heel protector;

a heel protector made of solid cushioning material.

17. A sports shoe or work shoe comprising an insole according to claim 1.

18. A method of using an insole according to claim 1 for at least one of the following activities: sports rehabilitation, balance improvement during sickness, and pain relief.

19. A method of using an insole according to claim 1 for the sport of golf, shooting, or running.

20. A method of modifying the balance yielding effect on a sports shoe in which the sports shoe is provided with a sole that has a top surface and a bottom side for contact with a base for standing or walking; wherein a first insole is provided on top of the top surface, without attachment to the top surface; wherein the first insole comprises a foot bed with supporting elastic elevations below an arch area and around a heel area, wherein the foot bed is intended for contact with a foot; the method comprising inserting an insole according to claim 1 between the first insole and the upper surface of the sole.

21. A method for producing an insole according to claim 1, wherein providing a first polymer foil (16.1) that is high-frequency weldable and a second polymer foil (16.2) with a greater stiffness than the first polymeric foil (16.1); laminating the first polymer foil (16.1) and the second polymer foil (16.2) together, thereby forming a laminate for an upper membrane foil (3.3); providing a high-frequency weldable lower membrane foil (3.2) and welding it together with the upper membrane foil (3.3) by high-frequency welding, thereby forming an enclosure (3.5), which is filled with water; wherein the first polymer foil (16.1) of the upper membrane foil (3.3) is oriented towards the enclosure (3.5) and the second polymer foil (16.2) is oriented in a direction away from the enclosure (3.5).

22. A method according to claim 21, wherein the first polymer foil (16.1) is made of polyurethane (PU), ethylene vinyl acetate (EVA), polyvinyl chloride (PVC) or polyvinylidene chloride (PVdC) or a mixture thereof.

23. A method according to claim 21, wherein the second polymer foil (16.2) is made of polyethylene vinyl acetate (PEVA), polyethylene (PE), polypropylene (PP), oriented polyamide (OPA) or polyamide (PA) or a mixture thereof.

* * * * *